US011175608B2

(12) United States Patent
Nose

(10) Patent No.: US 11,175,608 B2
(45) Date of Patent: Nov. 16, 2021

(54) DEVELOPING APPARATUS

(71) Applicant: CANON KABUSHIKI KAISHA, Tokyo (JP)

(72) Inventor: Katsuya Nose, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/869,666

(22) Filed: May 8, 2020

(65) Prior Publication Data

US 2020/0363754 A1 Nov. 19, 2020

(30) Foreign Application Priority Data

May 14, 2019 (JP) ..... JP2019-091657

(51) Int. Cl.
*G03G 15/08* (2006.01)

(52) U.S. Cl.
CPC ..... *G03G 15/0891* (2013.01)

(58) Field of Classification Search
CPC ..... G03G 15/0887; G03G 15/0889; G03G 15/0891; G03G 15/0893; G03G 2215/083; G03G 2215/0802; G03G 2215/0816; G03G 2215/0827; G03G 2215/0833; G03G 2215/0838
See application file for complete search history.

(56) References Cited

U.S. PATENT DOCUMENTS

| | | | | |
|---|---|---|---|---|
| 8,649,708 | B2 | 2/2014 | Watanabe et al. | |
| 9,405,229 | B1 | 8/2016 | Nose et al. | |
| 2016/0370733 | A1* | 12/2016 | Suenami | G03G 15/0889 |
| 2018/0335722 | A1* | 11/2018 | Ariizumi | G03G 15/0891 |
| 2019/0033751 | A1* | 1/2019 | Tsuda | G03G 15/0891 |

FOREIGN PATENT DOCUMENTS

| | | | |
|---|---|---|---|
| JP | 2002-72686 | A | 3/2002 |
| JP | 2010-256701 | A | 11/2010 |
| JP | 2011-175095 | A | 9/2011 |
| JP | 2012-159816 | A | 8/2012 |

* cited by examiner

*Primary Examiner* — Thomas S Giampaolo, II
(74) *Attorney, Agent, or Firm* — Venable LLP

(57) ABSTRACT

A developing apparatus includes a developer bearing member and a developer container having a first chamber and a second chamber. A first conveyance screw in the first chamber conveys developer in a first direction, and a second conveyance screw in the second chamber includes a first rotation shaft portion and a first blade portion to convey the developer in a second direction. The second conveyance screw also includes a second rotation shaft portion formed coaxially with the first rotation shaft portion and a second blade portion disposed downstream of the first blade portion to convey the developer in the first direction. Each of the first blade portion and the second blade portion are disposed in the second direction to face a first communicating portion. In addition, a developer discharging portion disposed downstream of the second blade portion in the second direction discharges a part of the developer from the developing apparatus.

20 Claims, 10 Drawing Sheets

FIG.7

| | FIRST SPIRAL PORTION | | | | SECOND SPIRAL PORTION | | | | |
|---|---|---|---|---|---|---|---|---|---|
| | OUTER DIAMETER A1 | SHAFT DIAMETER B1 | PITCH P1 | NUMBER OF THREADS N1 | OUTER DIAMETER A2 | SHAFT DIAMETER B2 | PITCH P2 | NUMBER OF THREADS N2 | REVERSE CONVEYANCE AREA L |
| EXAMPLE 1 | 14 | 6 | 20 | 3 | 14 | 6 | 25 | 3 | 14 |
| COMPARATIVE EXAMPLE 1 | 14 | 6 | 20 | 3 | 14 | 6 | 25 | 2 | 14 |
| COMPARATIVE EXAMPLE 2 | 14 | 6 | 20 | 3 | 14 | 8 | 25 | 3 | 14 |
| COMPARATIVE EXAMPLE 3 | 14 | 6 | 20 | 3 | 14 | 8 | 20 | 3 | 14 |

| LEFT SIDE OF EQUATION (1) | RIGHT SIDE OF EQUATION (1) | EQUATION (1) |
|---|---|---|
| 6720 | 8400 | SATISFIED |
| 6720 | 5600 | NOT SATISFIED |
| 6720 | 6300 | NOT SATISFIED |
| 6720 | 5040 | NOT SATISFIED |

| EXPERIMENT RESULT IN 70 ppm | EXPERIMENT RESULT IN 35 ppm |
|---|---|
| OK | OK |
| NG | OK |
| NG | OK |
| NG | OK |

FIG.9

| | FIRST SPIRAL PORTION | | | | | SECOND SPIRAL PORTION | | | | |
|---|---|---|---|---|---|---|---|---|---|---|
| | OUTER DIAMETER A1 | SHAFT DIAMETER B1 | PITCH P1 | NUMBER OF THREADS N1 | CLEARANCE AREA M | OUTER DIAMETER A2 | SHAFT DIAMETER B2 | PITCH P2 | NUMBER OF THREADS N2 | REVERSE CONVEYANCE AREA L |
| EXAMPLE 2 | 14 | 6 | 30 | 3 | 3 | 14 | 6 | 30 | 3 | 25 |
| COMPARATIVE EXAMPLE 4 | 14 | 6 | 30 | 3 | 3 | 14 | 6 | 25 | 3 | 25 |
| COMPARATIVE EXAMPLE 5 | 14 | 6 | 30 | 3 | 3 | 14 | 6 | 20 | 3 | 20 |
| COMPARATIVE EXAMPLE 6 | 14 | 6 | 30 | 3 | 3 | 14 | 6 | 30 | 2 | 25 |

| LEFT SIDE OF EQUATION (2) | RIGHT SIDE OF EQUATION (2) | EQUATION (2) |
|---|---|---|
| 15840 | 18000 | SATISFIED |
| 15840 | 15000 | NOT SATISFIED |
| 12240 | 9600 | NOT SATISFIED |
| 15840 | 12000 | NOT SATISFIED |

| EXPERIMENT RESULT IN 90 ppm | EXPERIMENT RESULT IN 45 ppm |
|---|---|
| OK | OK |
| NG | OK |
| NG | OK |
| NG | OK |

DEVELOPING APPARATUS

BACKGROUND OF THE INVENTION

Field of the Invention

The present invention relates to a developing apparatus.

Description of the Related Art

A known developing apparatus uses two-component developer that contains magnetic carrier and nonmagnetic toner. Such a developing apparatus includes an outlet for discharging excess developer. The outlet is disposed downstream in a direction in which a conveyance screw conveys the developer in a developer container.

For example, Japanese Patent Application Publication No. 2002-72686 discloses a technique in which a conveyance screw includes a forward-direction conveyance portion that conveys the developer in a forward direction, and a reverse-direction conveyance portion (reverse conveyance screw) that conveys the developer in a reverse direction. The developer that flows over the reverse conveyance screw is discharged from the outlet.

By the way, image forming apparatuses including a developing apparatus have different process speeds. In addition, one image forming apparatus may have a plurality of process speeds, and select one of them. If the process speed changes, the rotational speed of the conveyance screw also changes accordingly. Thus, when the process speed increases, more developer may flow over the reverse conveyance screw and may be excessively discharged.

SUMMARY OF THE INVENTION

An object of the present invention is to stabilize the amount of developer discharged from the developer discharging portion.

According to a first aspect of the present invention, a developing apparatus includes a developer bearing member configured to bear developer for developing an electrostatic latent image formed on an image bearing member, the developer containing toner and carrier, a developer container including a first chamber and a second chamber and configured to contain the developer, the second chamber being separated from the first chamber by a partition wall, a first communicating portion configured to permit the developer to communicate from the second chamber to the first chamber, a second communicating portion configured to permit the developer to communicate from the first chamber to the second chamber, a first conveyance screw disposed in the first chamber and configured to convey the developer in a first direction toward the second communicating portion from the first communicating portion, a second conveyance screw disposed in the second chamber and including a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, and a second blade portion disposed downstream of the first blade portion in the second direction, spirally formed on an outer circumferential surface of the second rotation shaft portion, and configured to convey the developer in the first direction and deliver the developer from the second chamber to the first chamber through the first communicating portion in cooperation with the first blade portion, and a developer discharging portion disposed downstream of the second blade portion in the second direction and configured to discharge a part of the developer from the developing apparatus. The developing apparatus satisfies a following expression $(A1-B1)\times P1\times N1\leq(A2-B2)\times P2\times N2$ where A1 is an outer diameter of the first blade portion, B1 is an outer diameter of the first rotation shaft portion, P1 is a spiral pitch of the first blade portion, N1 is a number of threads of the first blade portion, A2 is an outer diameter of the second blade portion, B2 is an outer diameter of the second rotation shaft portion, P2 is a spiral pitch of the second blade portion, and N2 is a number of threads of the second blade portion.

According to a second aspect of the present invention, a developing apparatus includes a developer bearing member configured to bear developer for developing an electrostatic latent image formed on an image bearing member, the developer containing toner and carrier, a developer container including a first chamber and a second chamber and configured to contain the developer, the second chamber being separated from the first chamber by a partition wall, a first communicating portion configured to permit the developer to communicate from the second chamber to the first chamber, a second communicating portion configured to permit the developer to communicate from the first chamber to the second chamber, a first conveyance screw disposed in the first chamber and configured to convey the developer in a first direction toward the second communicating portion from the first communicating portion, a second conveyance screw disposed in the second chamber and including a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, a second blade portion disposed downstream from the first blade portion in the second direction, spirally formed on an outer circumferential surface of the second rotation shaft portion, and configured to convey the developer in the first direction and deliver the developer from the second chamber to the first chamber through the first communicating portion in cooperation with the first blade portion, and a clearance portion having no spiral blade formed on the outer circumferential surface of the first rotation shaft portion and extending from an end of the second blade portion on an upstream side in the second direction toward the first direction, the clearance portion being disposed within a range of L, a length of the second blade portion in a rotation-axis direction being denoted by L, and a developer discharging portion disposed downstream of the second blade portion in the second direction and configured to discharge a part of the developer from the developing apparatus. The developing apparatus satisfies a following expression: $(A1-B1)\times P1\times N1\times(L-M)\leq(A2-B2)\times P2\times N2\times L$ where M is a length of the clearance portion in the rotation-axis direction, A1 is an outer diameter of the first blade portion, B1 is an outer diameter of the first rotation shaft portion, P1 is a spiral pitch of the first blade portion, N1 is a number of threads of the first blade portion, A2 is an outer diameter of the second blade portion, B2 is an outer diameter of the second rotation shaft portion, P2 is a spiral pitch of the second blade portion, and N2 is a number of threads of the second blade portion.

Further features of the present invention will become apparent from the following description of exemplary embodiments with reference to the attached drawings.

BRIEF DESCRIPTION OF THE DRAWINGS

FIG. 7 is a table illustrating a result of an experiment conducted to confirm an effect of the first embodiment.

FIG. 9 is a table illustrating a result of an experiment conducted to confirm an effect of the second embodiment.

DESCRIPTION OF THE EMBODIMENTS

First Embodiment

A first embodiment will be described with reference to FIGS. 1 to 7. First, a schematic configuration of an image forming apparatus of the present embodiment will be described with reference to FIGS. 1 to 3.

Image Forming Apparatus

Figure 1:
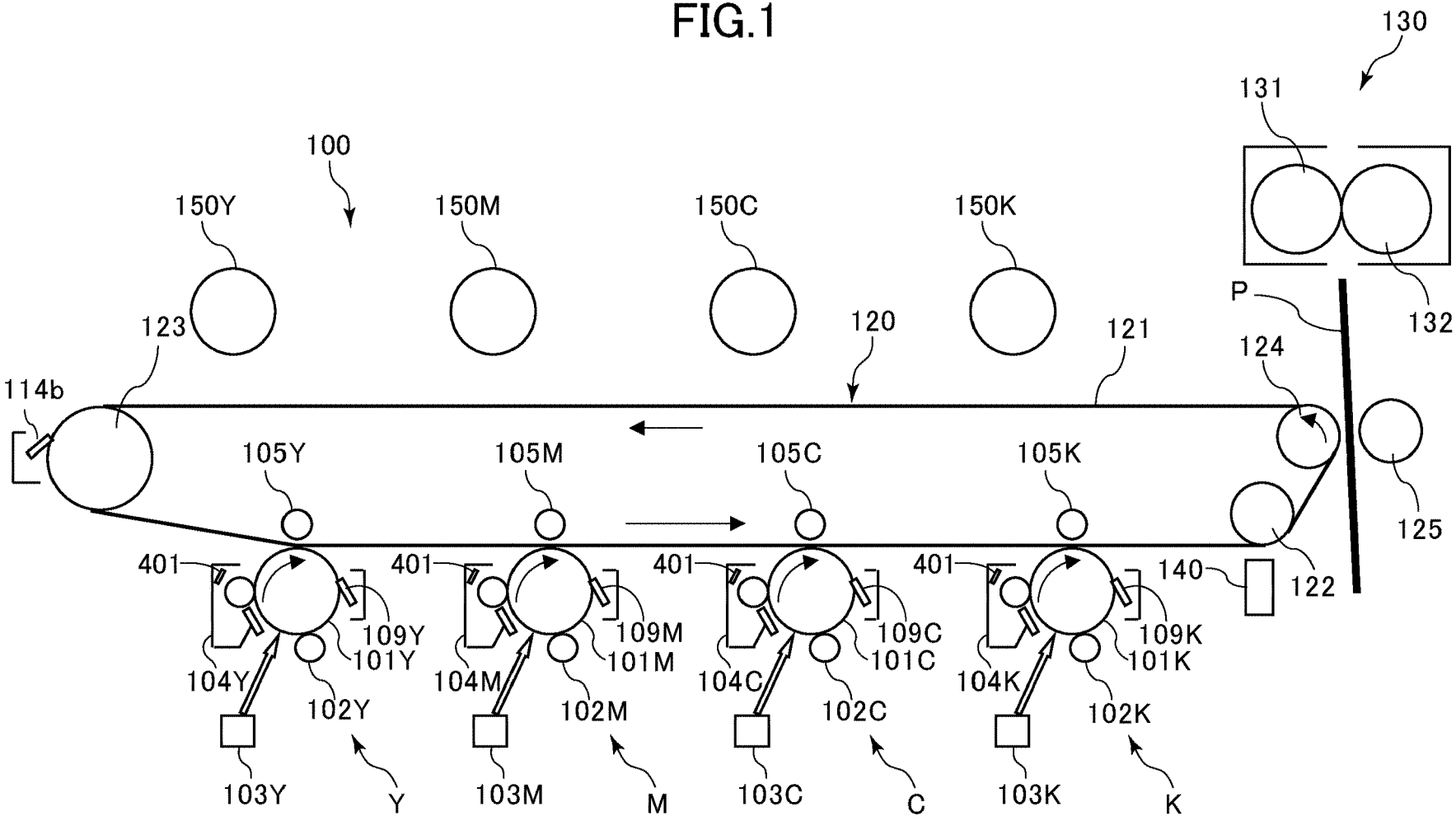
FIG. 1 is a diagram illustrating a schematic configuration of an image forming apparatus of a first embodiment.

As illustrated in FIG. 1, an image forming apparatus 100 of the present embodiment includes four image forming stations Y, M, C, and K, disposed in an apparatus body of the image forming apparatus 100. The image forming stations Y, M, C, and K respectively include photosensitive drums 101Y, 101M, 101C, and 101K, which serve as image bearing members. Above the image forming stations, an intermediate transfer apparatus 120 is disposed. In the intermediate transfer apparatus 120, an intermediate transfer belt 121, which serves as an intermediate transfer member, is stretched and wound around rollers 122, 123, and 124; and is moved (rotated) in a direction indicated by arrows of FIG. 1.

The configurations of the image forming stations Y, M, C, and K are the same as each other, except for the color of the toner. Thus, in the following description, only the image forming station Y will be described as one example, and the description for the other image forming stations will be omitted. In the figures, components of each of the other image forming stations are given reference numerals added with an index of M, C, or K, which indicates a corresponding image forming station.

Figure 2:
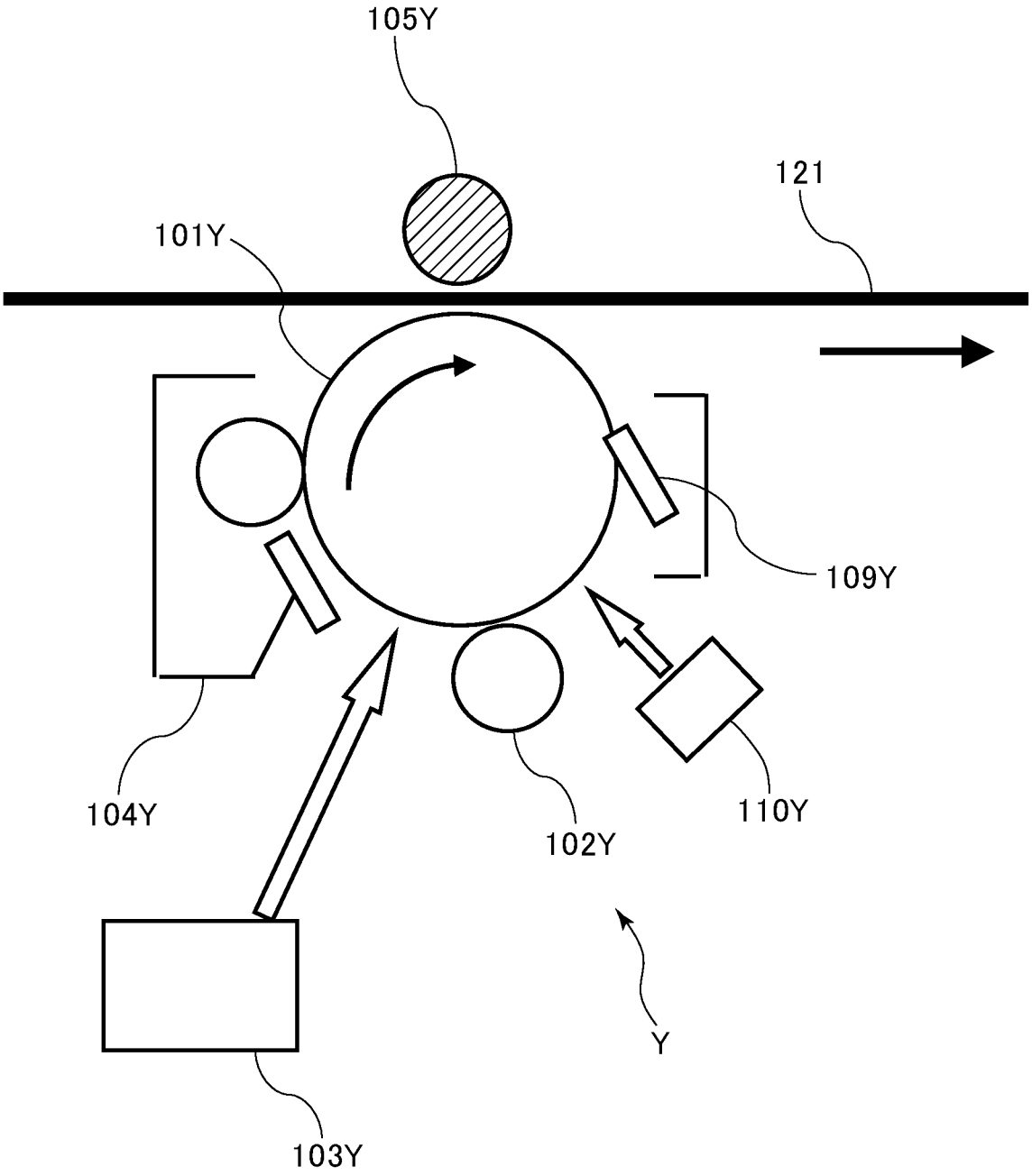
FIG. 2 is a diagram illustrating a schematic configuration of an image forming station of the first embodiment.

Around the photosensitive drum 101Y, a primary charging apparatus 102Y, a developing apparatus 104Y, and a cleaner 109Y are disposed. With reference to FIGS. 1 and 2, a configuration formed around the photosensitive drum 101Y and an image forming operation will be described. The photosensitive drum 101Y is rotated in a direction indicated by an arrow. The surface of the photosensitive drum 101Y is uniformly charged by the primary charging apparatus 102Y, which has a charging roller that contacts and charges the photosensitive drum 101Y. The charged surface of the photosensitive drum 101Y is exposed by a laser-beam emitting element 103Y that is an exposure device, so that an electrostatic latent image is formed on the surface. The electrostatic latent image formed in this manner is visualized with the toner supplied from the developing apparatus 104Y, and a toner image is formed on the photosensitive drum 101Y. Thus, in the image forming stations Y, M, C, and K, toner images of yellow (Y), magenta (M), cyan (C), and black (K) are formed, respectively.

The toner image formed in the image forming station Y is transferred onto the intermediate transfer belt 121 by a primary transfer bias, which is applied by the primary transfer roller 105Y. The intermediate transfer belt 121 is made of polyimide resin. Similarly, the toner images formed in the other image forming stations are also transferred onto the intermediate transfer belt 121 such that one toner image is superposed on another. The four-color toner images formed on the intermediate transfer belt 121 are transferred onto a recording material P (e.g. a sheet such as a paper sheet or an OHP sheet) by a secondary transfer roller 125. The secondary transfer roller 125 is a secondary transfer means that faces the roller 124.

The toner having not been transferred onto the recording material P and left on the intermediate transfer belt 121 is removed by an intermediate transfer belt cleaner 114*b*. The recording material P, onto which the toner image has been transferred, is pressurized and heated by a fixing apparatus 130, which includes fixing rollers 131 and 132. With this operation, the toner image is fixed to the recording material P. The primary-transfer remaining toner left on the photosensitive drum 101Y after the primary transfer is removed by the cleaner 109Y, and the electrical potential produced on the photosensitive drum 101Y is erased by a pre-exposure lamp 110Y (FIG. 2) for forming the next image.

In addition, the image forming apparatus 100 includes toner bottles 150Y, 150M, 150C, and 150K. The toner bottles, which serve as developer containing members, contain developers with different colors (i.e. toners in the present embodiment). The toner bottles 150Y, 150M, 150C, and 150K can be detachably attached to the apparatus body of the image forming apparatus 100. In a state where the toner bottles 150Y, 150M, 150C, and 150K are attached to the apparatus body at predetermined positions, the toner bottles 150Y, 150M, 150C, and 150K can supply the toners with different colors, to the developing apparatuses 104Y, 104M, 104C, and 104K.

Figure 3:
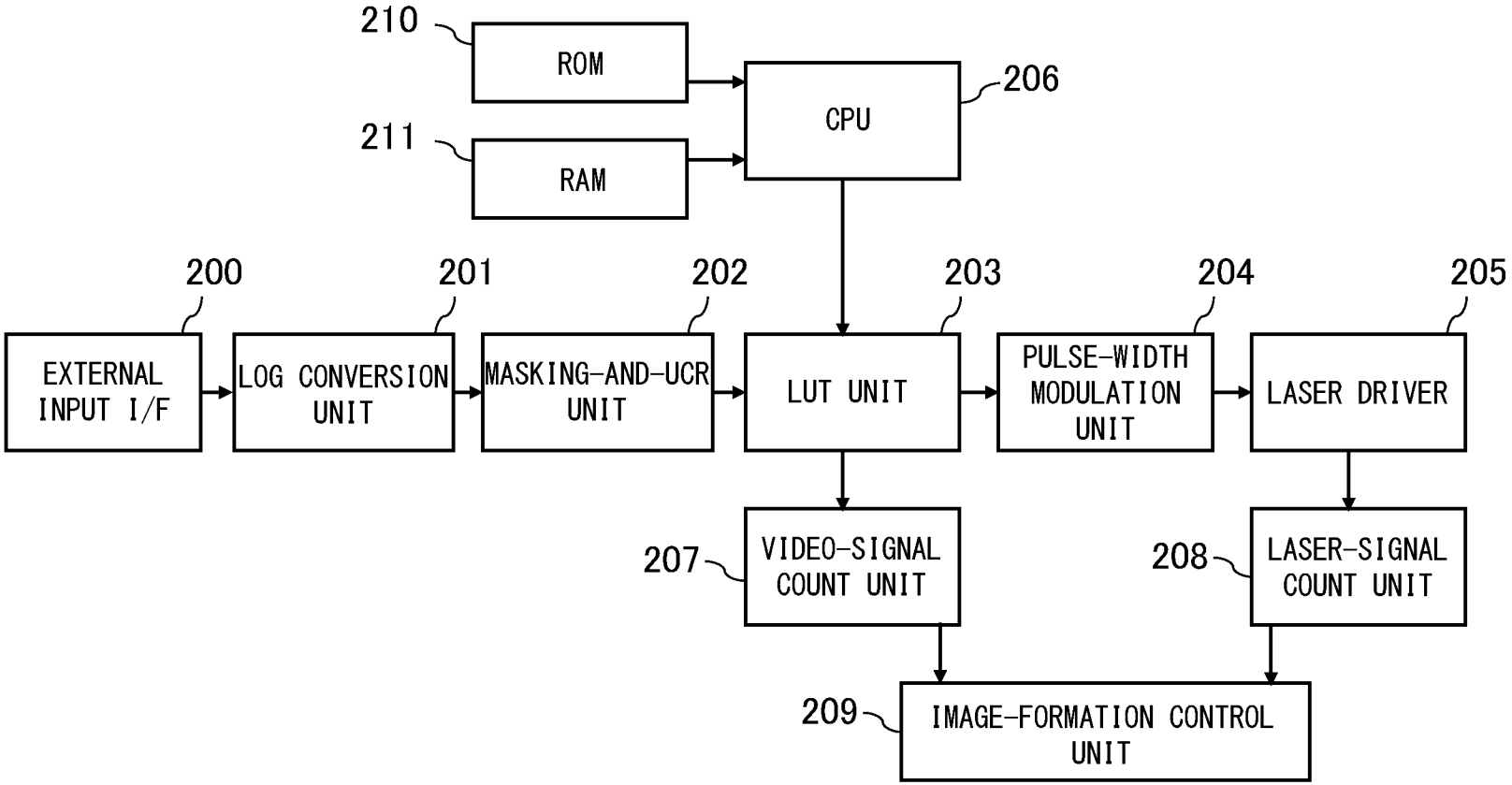
FIG. 3 is a block diagram illustrating a system configuration of the image forming apparatus of the first embodiment.

Next, a system configuration of an image processing unit of the image forming apparatus 100 of the present embodiment will be described with reference to FIG. 3. The image processing unit receives RGB color-image data as necessary from an external device (not illustrated), such as a document scanner or a computer (image processing device), via an external input interface (external input I/F) 200.

A LOG conversion unit 201 converts the RGB image data, which is brightness data, to CMY density data (CMY image data), by referring to a lookup table (LUT) constituted by data stored in a ROM 210. A masking-and-UCR unit 202 extracts black (K) component data from the CMY image data, and performs a matrix operation on the CMY image data for correcting impureness in color produced on a recording material.

A lookup table unit (LUT unit) 203 performs density correction on each color of the CMYK image data by using a gamma lookup table (γ lookup table), for making the image data have an ideal gradation property of a printer portion. The γ lookup table is created by using data stored in a RAM 211, and the contents of the γ lookup table is set by a CPU 206.

A pulse-width modulation unit 204 receives image data (image signal) from the LUT unit 203, and outputs a pulse signal whose pulse width corresponds to a level of the image data. A laser driver 205 drives the laser-beam emitting elements 103Y to 103K in accordance with the pulse signal, and irradiates surfaces of the photosensitive drums 101Y to 101K (FIG. 1) with the laser beam for forming electrostatic latent images on the surfaces of the photosensitive drums 101Y to 101K.

A video-signal count unit 207 integrates levels (each level has a value from 0 to 255) of pixels of image data (600 dpi in the present embodiment), which forms a single image and is received by the LUT unit 203. The image-data integrated value is referred to as a video count value. The maximum value of the video count value is 529 when all the pixels of an A4-size single image have a level of 255. When the video count value cannot be calculated by the video-signal count unit 207 due to the configuration of the video-signal count unit 207, it may be calculated by a laser-signal count unit 208. In this case, the laser-signal count unit 208 performs the same calculation on an image signal outputted from a laser driver 205.

In addition, an image-formation control unit 209 drives and controls components of each of the above-described image forming stations. For example, the image-formation control unit 209 controls the laser driver 205 so that the laser driver 205 drives the laser-beam emitting elements 103Y to 103K in accordance with a pulse signal produced from the image data.

The image forming apparatus 100 of the present embodiment has a wide range of productivity of 35 to 70 ppm (i.e. the number of sheets outputted per minute). Thus, the image forming apparatus 100 can form an image at any one of a plurality of process speeds, with a single hardware configuration. For example, a 70-ppm machine having a productivity of 70 ppm forms an image at a process speed of 300 mm/sec. Similarly, a 35-ppm machine having a productivity of 35 ppm forms an image at a process speed of 150 mm/sec.

Developing Apparatus

Next, the developing apparatus 104Y of the present embodiment will be described in detail with reference to FIGS. 4 and 5. Since the configuration of the other developing apparatuses 104M, 104C, and 104K are the same as that of the developing apparatus 104Y, the description thereof will be omitted. The developing apparatus 104Y includes a developer container 20, which contains two-component developer. The two-component developer contains nonmagnetic toner and magnetic carrier. The developing apparatus 104Y also includes a developing sleeve 24 and a brush cutting member 25, both disposed in the developer container 20. The developing sleeve 24 serves as a developer bearing member, and the brush cutting member 25 regulates developer brush (referred also as to magnetic brush) born by the developing sleeve 24.

The interior of the developer container 20 is partitioned into a developing chamber 21*a* and an agitating chamber 21*b* by a partition wall 23 at a substantially central portion of the developer container 20. The developing chamber 21*a* is a first chamber, and the agitating chamber 21*b* is a second chamber. The partition wall 23 extends in a direction orthogonal to FIG. 4, and the developing chamber 21*a* and the agitating chamber 21*b* are arranged on the right and left sides in a horizontal direction. The developer is contained in the developing chamber 21*a* and the agitating chamber 21*b*. In addition, a first conveyance screw 22*a* that serves as a first conveyance member is disposed in the developing chamber 21*a*, and a second conveyance screw 22*b* that serves as a second conveyance member is disposed in the agitating chamber 21*b*.

Figure 5:
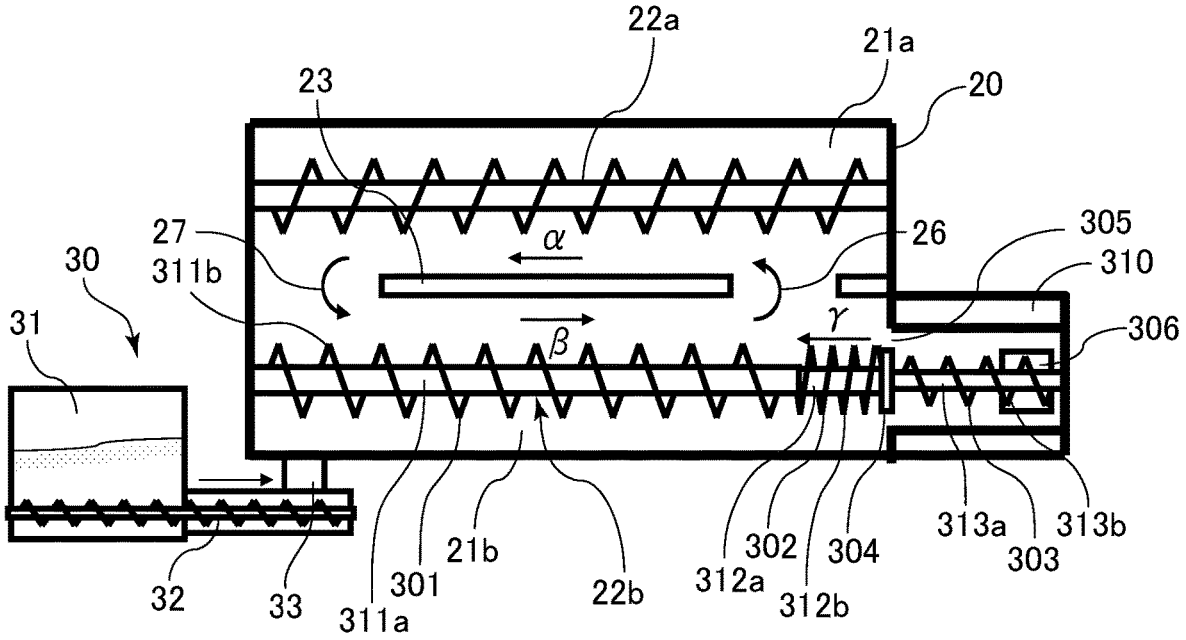
FIG. 5 is a longitudinal-sectional view schematically illustrating the developing apparatus and the toner supply configuration of the first embodiment.

As illustrated in FIG. 5, the first conveyance screw 22*a* is disposed in a bottom portion of the developing chamber 21*a*, substantially parallel to an axis of the developing sleeve 24. When rotated, the first conveyance screw 22*a* conveys the developer of the developing chamber 21*a* toward one direction along the axis of the developing sleeve 24. That is, the first conveyance screw 22*a* conveys the developer of the developing chamber 21*a* from a later-described first communicating opening 26 toward a second communicating opening 27 in a direction (first direction) indicated by an arrow α of FIG. 5. The second conveyance screw 22*b* is disposed in a bottom portion of the agitating chamber 21*b*, substantially parallel to the first conveyance screw 22*a*. The second conveyance screw 22*b* conveys the developer of the agitating chamber 21*b* toward a direction opposite to the direction in which the first conveyance screw 22*a* conveys the developer of the developing chamber 21*a*. That is, the second conveyance screw 22*b* conveys the developer of the agitating chamber 21*b* from the second communicating opening 27 toward the first communicating opening 26 in a direction indicated by an arrow β of FIG. 5.

Thus, since the first conveyance screw 22*a* and the second conveyance screw 22*b* are rotated to convey the developer, the developer circulates through the developing chamber 21*a* and the agitating chamber 21*b*. In this circulation, the developer passes through the first communicating opening 26 and the second communicating opening 27 (see FIG. 5) formed in both edge portions of the partition wall 23. That is, for forming the circulation path along which the developer circulates through the developing chamber 21*a* and the agitating chamber 21*b*, the partition wall 23 has the first communicating opening 26 and the second communicating opening 27 that cause the developing chamber 21*a* and the agitating chamber 21*b* to communicate with each other. Specifically, the first communicating opening 26 that serves as a first communicating portion allows the developer to flow (communicate) from the agitating chamber 21*b* to the developing chamber 21*a*. The second communicating opening 27 that serves as a second communicating portion allows the developer to flow (communicate) from the developing chamber 21*a* to the agitating chamber 21*b*. While the developer that contains the toner and the carrier is conveyed along the circulation path, the toner and the carrier are rubbed against each other and charged by friction.

Figure 4:
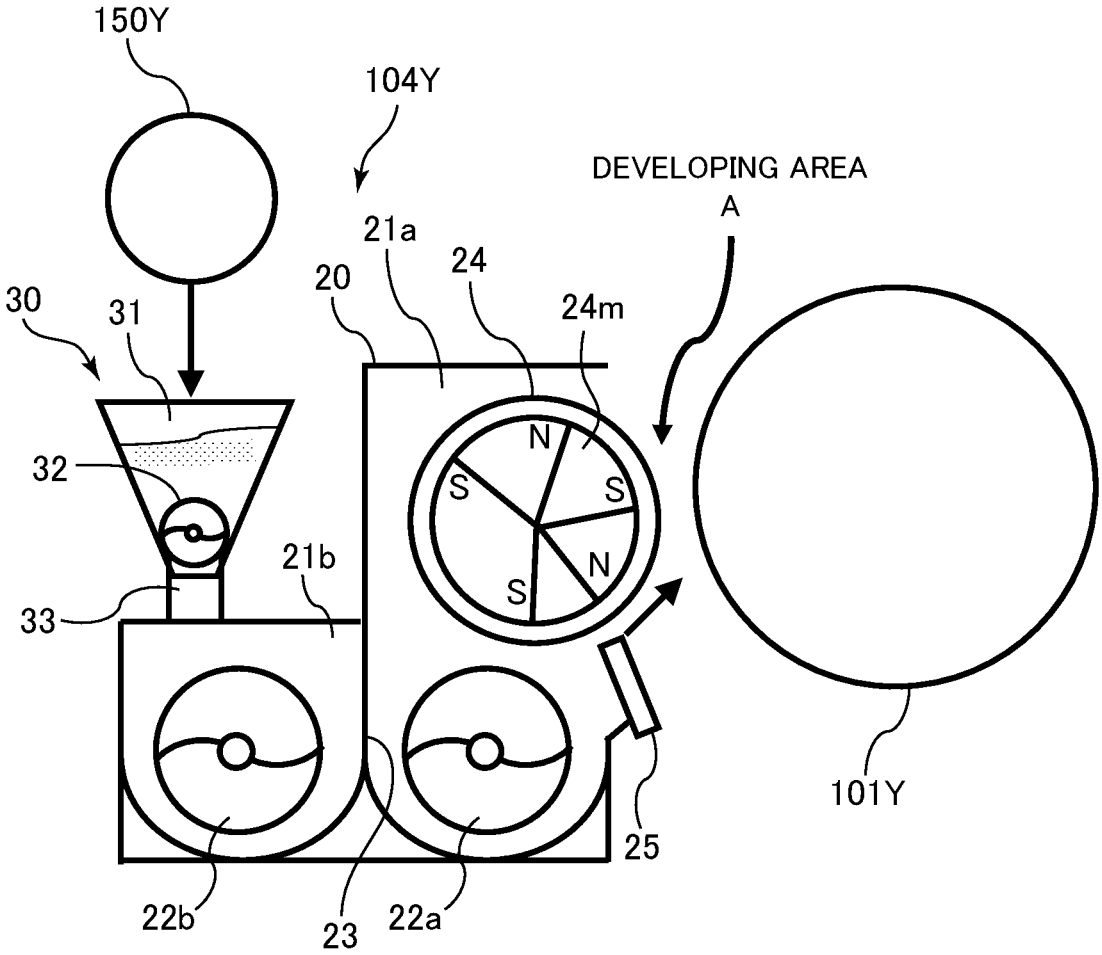
FIG. 4 is a cross-sectional view schematically illustrating a developing apparatus and a toner supply configuration of the first embodiment.

As illustrated in FIG. 4, the developer container 20 has an opening formed in a developing area A, which faces the photosensitive drum 101Y. The developing sleeve 24 is rotatably arranged such that a portion of the developing sleeve 24 is exposed from the opening toward the photosensitive drum 101Y. In the present embodiment, the diameter of the developing sleeve 24 is 18 mm, the diameter of the photosensitive drum 101Y is 30 mm, and the shortest distance between the developing sleeve 24 and the photosensitive drum 101Y is about 300 μm. With this arrangement, the developing can be performed in a state where the developer conveyed to the developing area A contacts the photosensitive drum 101Y. The developing sleeve 24 is formed like a cylinder and made of nonmagnetic material such as aluminum or stainless steel. Inside the developing sleeve 24, a magnet roller 24*m* that is a magnetic-field generating means is disposed so as not to rotate.

When the developing is performed, the developing sleeve 24 configured as described above rotates toward a direction indicated by an arrow (counterclockwise) while bearing the two-component developer of the developing chamber 21*a*. The thickness of the layer of the developer born by the developing sleeve 24 is regulated by the brush cutting member 25 cutting the magnetic brush. The developing sleeve 24 conveys the developer whose layer thickness is regulated, to the developing area A that faces the photosensitive drum 101Y; and supplies the developer to an electrostatic latent image formed on the photosensitive drum 101Y, to develop the electrostatic latent image. In the developing, for increasing the efficiency of developing, that is, for increasing the percentage of toner supplied to the electrostatic latent image, the developing sleeve 24 is applied with a development bias voltage from a power source. The development bias voltage is generated such that a direct-current voltage is added with an alternate-current voltage. In the present embodiment, the direct-current voltage has a value of −550 V, and the alternate-current voltage has a peak-to-peak voltage Vpp of 1600 V and a frequency f of 11 kHz. However, the direct-current voltage and the alternate-current voltage waveform are not limited to the above description.

In the two-component magnetic brush developing, when the alternate-current voltage is applied to the developing sleeve 24, the efficiency of developing commonly increases, increasing the quality of image. In this case, however, toner fog easily occurs. Thus, for preventing the toner fog, a potential difference is produced between the direct-current voltage applied to the developing sleeve 24 and the charge potential (i.e. white-background potential) of the photosensitive drum 101Y.

The brush cutting member (regulation blade) 25 is a plate-like nonmagnetic member extending along the longitudinal axis of the developing sleeve 24 and made of aluminum or the like. In addition, the brush cutting member 25 is disposed upstream with respect to the photosensitive drum 101Y in the rotational direction of the developing sleeve 24. Thus, both the toner and the carrier of the developer are conveyed to the developing area A through a clearance between the leading edge of the brush cutting member 25 and the developing sleeve 24.

The amount of cut of the magnetic brush of developer born by the developing sleeve 24 is regulated by adjusting the clearance between the brush cutting member 25 and the developing sleeve 24, and thereby the amount of developer conveyed to the developing area A is adjusted. In the present embodiment, the amount of coating of the developer per unit area of the surface of the developing sleeve 24 is regulated to 30 mg/cm$^2$, by the brush cutting member 25. The clearance between the brush cutting member 25 and the developing sleeve 24 is set to a value in a range from 200 to 1000 preferably in a range from 300 to 700 In the present embodiment, the clearance is 400 μm.

In the developing area A, the developing sleeve 24 of the developing apparatus 104Y rotates in the same direction as that of the photosensitive drum 101Y. The circumferential speed ratio of the speed of the developing sleeve 24 to the speed of the photosensitive drum 101Y is 1.80. The circumferential speed ratio is larger than 0 and equal to or smaller than 3.6, and preferably, equal to or larger than 0.5 and equal to or smaller than 2.0. As the moving speed ratio (the circumferential speed ratio) increases, the efficiency of developing increases. However, if the moving speed ratio is too large, problems such as toner fly and developer deterioration may occur. Thus, the moving speed ratio is preferably set in the above-described range.

Developer

Next, the two-component developer contained in the developer container 20 and containing toner and carrier will be described in detail. The toner includes colored resin particles and colored particles. Each of the colored resin particles includes binding resin, coloring agent, and other additives as necessary; each of the colored particles includes external additive such as colloidal-silica fine powder. The toner is polyester resin that can be negatively charged, and the volume average particle diameter of the toner is preferably equal to or larger than 4 μm and equal to or smaller than 10 More preferably, the volume average particle diameter is equal to or smaller than 8 In addition, the toner that is often used in recent years has a low melting point or a low glass transition point (e.g. Tg≤70° C.) to increase its fixing property. Furthermore, the toner may contain wax to increase its separation property that is required after the fixing. The developer of the present embodiment is pulverized toner that contains wax.

The carrier may be made of metal, alloy, or ferrite oxide. The metal may be iron (the surface of which may or may not be oxidized), nickel, cobalt, manganese, chromium, or rare-earth metal; and the alloy may be made by using the above-described examples of the metal. The method of manufacturing these magnetic particles is not limited to a specific method. The weight average particle diameter of the carrier is in a range from 20 to 60 μm, and preferably, in a range from 30 to 50 μm. The resistivity of the carrier is equal to or larger than $10^7$ Ωcm, and preferably, equal to or larger than $10^8$ Ωcm. In the present embodiment, the resistivity is $10^8$ Ωcm.

The volume average particle diameter of the toner of the present embodiment was measured by using the following instrument and method. The measuring instrument used was an instrument for measuring sheath flow electrical resistance particle size distribution, SD-2000, made by SYSMEX CORPORATION. The measurement was performed as follows. First, a dispersant of 0.1 ml and a measurement sample of 0.5 to 50 mg was added to an electrolytic aqueous solution of 100 to 150 ml. The dispersant was a surfactant, but preferably may be alkyl benzene sulfonate. The electrolytic aqueous solution was an NaCl aqueous solution of 1% prepared by using primary sodium chloride. The electrolytic aqueous solution in which the measurement sample was suspended was dispersed by an ultrasonic disperser for about 1 to 3 minutes. Then, a particle size distribution of particles having diameters of 2 to 40 μm was measured by using the above-described instrument for measuring sheath flow electrical resistance particle size distribution, SD-2000, and by using apertures of 100 μm. A volume average distribution was determined from the particle size distribution, and then the volume average particle diameter was determined from the volume average distribution.

The resistivity of the carrier of the present embodiment was measured by using a sandwich-type cell having a measurement electrode area of 4 cm$^2$ and an interelectrode distance of 0.4 cm. Specifically, one electrode was pressed by a weight of 1 kg, and a voltage E (V/cm) was applied across both electrodes. In this state, the resistivity of the carrier was determined from the current that flowed in the circuit.

Supplying of Developer

Next, a method of supplying the developer in the present embodiment will be described with reference to FIGS. 4 and 5. A supplying apparatus 30 that supplies the developer to the developing apparatus 104Y is disposed above the developing apparatus 104Y. The supplying apparatus 30 includes a hopper 31, which serves as a storage portion that stores the two-component developer in which toner and carrier are mixed with each other (the two-component developer is the developer to be supplied, and the ratio of the toner to the developer is typically in a range from 80 to 100%).

The hopper 31 is supplied with the developer from the toner bottle 150Y, which serves as a developer containing member. The toner bottle 150Y supplies the two-component developer to the hopper 31 when driven by a driving mechanism (not illustrated). The supplying operation is performed in accordance with a detection result by a sensor that detects the amount of developer of the hopper 31. That is, when the amount of developer of the hopper 31 detected by the sensor is less than a predetermined amount, the above-described driving mechanism is driven and the developer is supplied from the toner bottle 150Y to the hopper 31.

The hopper 31 includes a screw-like supply-and-conveyance member, that is, a supplying screw 32 disposed in a bottom portion of the hopper 31. The supplying screw 32 extends such that one end of the supplying screw 32 is positioned at a position of a developer supplying inlet 33, which is disposed at a rear end portion of the developing apparatus 104Y. The developer supplying inlet 33 communicates with the agitating chamber 21*b* of the developer container 20. The supplying screw 32 is driven and rotated by a supplying motor (not illustrated), which serves as a supplying-and-driving means. Thus, the supplying screw 32 is driven and rotated by the supplying motor, and conveys and supplies the developer from the hopper 31 to the agitating chamber 21*b*.

The toner is supplied from the hopper 31 to the developer container 20 though the developer supplying inlet 33, by the amount of toner consumed in an image forming operation, by the rotational force of the supplying screw 32 and the gravitational force applied to the developer. The amount of developer to be supplied from the hopper 31 to the developing apparatus 104Y can be substantially determined by using the number of rotations of the supplying screw 32. The number of rotations of the supplying screw 32 is determined by the CPU 206 (FIG. 3) that serves as a control means (control unit), depending on a video count value of image data, a detection result by an inductance sensor (toner density sensor) (not illustrated) disposed in the developer container 20, and the like.

Discharging of Excess Developer of Developing Apparatus

Next, a method of discharging excess developer of the developing apparatus 104Y in the present embodiment will be described with reference to FIG. 5. The developing apparatus 104Y is supplied with developer as described above. If the amount of developer of the developing apparatus 104Y exceeds a predetermined amount, the developing apparatus 104Y discharges excess developer of the developer container 20 from the outlet 306, which serves as a developer discharging portion. Such a system is called a trickle system or an auto carrier refreshment (ACR) system. Thus, the developing apparatus 104Y includes a discharging portion 310 in which the outlet 306 is formed for discharging the excess developer. The outlet 306 is positioned at a position out of the circulation path formed by the developing chamber 21*a* and the agitating chamber 21*b*, and disposed opposite to the second communicating opening 27 with respect to the first communicating opening 26. The outlet 306 discharges a portion (excess developer) of the developer conveyed by the second conveyance screw 22*b*.

The second conveyance screw 22*b* includes a first spiral portion 301 that serves as a forward-direction conveyance portion, a second spiral portion 302 that serves as a reverse-direction conveyance portion, and a third spiral portion 303 that serves as an introduction portion and a discharge-and-conveyance portion. The first spiral portion 301 conveys the developer in a forward direction extending from the second communicating opening 27 toward the first communicating opening 26, that is, in a second direction (indicated by an arrow β) opposite to the first direction.

The second spiral portion (reverse conveyance screw) 302 is disposed downstream from the first spiral portion 301 in the forward direction, and extends from a first position that faces the first communicating opening 26 to a second position positioned upstream from the outlet 306 in the forward direction. The second spiral portion 302 conveys the developer in the reverse direction opposite to the forward direction, that is, in the first direction (indicated by an arrow γ).

The third spiral portion 303 is disposed downstream from the second spiral portion 302 in the forward direction. The third spiral portion 303 does at least not convey the developer toward the reverse direction, and guides the developer that flows over the second spiral portion 302, to the outlet 306. In the present embodiment, the third spiral portion 303 conveys the developer that flows over the second spiral portion 302, to the outlet 306. The conveyance direction of the third spiral portion 303 is the forward direction opposite to the direction in which the second spiral portion 302 conveys the developer.

Hereinafter, the detailed description thereof will be made. The first spiral portion 301 includes a first rotation shaft 311*a* that serves as a first rotation shaft portion, and a first blade portion 311*b* spirally formed on the first rotation shaft 311*a*. The second spiral portion 302 includes a second rotation shaft 312*a* formed coaxially with the first rotation shaft 311*a* and serving as a second rotation shaft portion, and a second blade portion 312*b* spirally formed on the second rotation shaft 312*a* and different from the first blade portion 311*b* in the direction of the blade. The third spiral portion 303 includes a third rotation shaft 313*a* formed coaxially with the first rotation shaft 311*a*, and a third blade portion 313*b* spirally formed on the third rotation shaft 313*a*. The first spiral portion 301, the second spiral portion 302, and the third spiral portion 303 are formed integrally with each other.

The first spiral portion 301 conveys the developer of the developer container 20 in the direction extending from the communicating opening 27 to the communicating opening 26, that is, downstream in the circulation path. The second spiral portion (reverse conveyance screw) 302 is joined with the first spiral portion 301 and located downstream from the first spiral portion 301 in the direction in which the first spiral portion 301 conveys the developer. The second spiral portion 302 conveys the developer so that the developer out of the circulation path is pushed back to the circulation path. The joint portion between the first spiral portion 301 and the second spiral portion 302 faces the first communicating opening 26.

In addition, a discharging opening 305 is formed upstream from the second spiral portion 302 in the direction in which the second spiral portion 302 conveys the developer. The discharging opening 305 discharges a portion of the circulating developer to the outside of the developer container 20. However, most of the developer conveyed toward the discharging opening 305 by the first spiral portion 301 of the second conveyance screw 22*b* is pushed back by the second spiral portion 302, without being discharged from the discharging opening 305. The developer that is not discharged is delivered to the first conveyance screw 22*a* through the first communicating opening 26.

On the other hand, the developer that is not pushed back by the second spiral portion 302 passes through the discharging opening 305, and is conveyed to the outlet 306 by the third spiral portion 303 (discharging screw), which conveys the developer in the direction in which the first spiral portion 301 conveys the developer. The developer having reached the outlet 306 falls freely from the outlet 306, and is discharged from the outlet 306 to the outside of the developer container 20, as excess developer. The discharged excess developer is collected by a collection container (not illustrated). A configuration of the first spiral portion 301, the second spiral portion 302, and the third spiral portion 303 will be described in detail later.

In the present embodiment, the second spiral portion 302 of the second conveyance screw 22*b* has a disk-shaped flange portion 304 formed at an end portion of the second spiral portion 302 on the downstream side in the forward direction, so as to cover one portion of the discharging opening 305. The flange portion 304 reduces the difference in inertia of the developer conveyed toward the discharging opening 305, by producing the difference in conveyance capability between the first spiral portion 301 and the second spiral portion 302 of the second conveyance screw 22*b*. The flange portion 304 stabilizes the amount of discharged developer, by eliminating the developer that flows from an end portion of the blade of the second spiral portion 302 on the downstream side in the forward direction, to the discharging opening 305 (the end portion of the blade of the second spiral portion 302 on the downstream side in the forward direction and an end portion of the blade of the third spiral portion 303 on the upstream side in the forward direction forms a gap). In addition, the flange portion 304 covers an end portion of the second spiral portion 302 that faces the discharging opening 305, not to expose a valley portion of the screw blade of the second spiral portion 302 to the discharging opening 305. With this structure, the amount of discharged developer can be stabilized even when the rotational speed of the second conveyance screw 22*b* varies.

Balance of Amount of Developer to be Supplied and Amount of Developer to be Discharged In the above-described configuration of the developing apparatus, the ACR system balances the amount of developer to be supplied and the amount of developer to be discharged. Hereinafter, the ACR system will be described. The amount of developer to be supplied is determined so that the developer, in which toner and carrier are mixed, contains the toner by the amount of toner by which toner has been consumed for forming output images and a control patch image. Thus, the amount of developer to be supplied varies depending on the mixing ratio between the toner and the carrier of the developer to be supplied.

Specifically, as the mixing ratio of the carrier increases, the amount of supplied developer increases, increasing costs. However, since new carrier is supplied more, the toner can be constantly charged stably. On the other hand, as the mixing ratio of the carrier decreases, the amount of supplied developer decreases, decreasing running costs. However, the ratio of deteriorated carrier contained in the developer of the developer container increases. As a result, the toner will be charged unstably, making it difficult to stabilize the quality of image for a long time.

As previously described, regarding the mixing ratio between the toner and the carrier of the developer, the mixing ratio of the carrier to the developer is in a range from about 0 to 20%. In the present embodiment, the mixing ratio of the toner to the carrier of the developer is 9:1.

The amount of developer to be supplied is determined in this manner. By the way, the amount of developer of the developer container 20 gradually increases as the number of formed images increases. This is because the carrier is not consumed and circulates in the developer container 20, although the toner is consumed for forming images. When the amount of developer increases, the surface of the developer of the developing chamber 21*a* and the agitating chamber 21*b* rises. In particular, if the surface of the developer of the agitating chamber 21*b* rises, the second spiral portion 302 cannot push back the developer conveyed by the first spiral portion 301 of the second conveyance screw 22*b*, and a portion of the developer flows over the second spiral portion 302. The developer that flows over the second spiral portion 302 passes through the discharging opening 305, and is discharged to the outlet 306 by the third spiral portion 303. When the developer is discharged, the surface of the developer of the agitating chamber 21*b* falls. As a result, the second spiral portion 302 can push back the toner and suppress more developer from being discharged. Thus, since the amount of discharged developer decreases, the developer can be prevented from being excessively reduced. In such a mechanism, the amount of developer of the developer container 20 is balanced.

Second Conveyance Screw

As described above, the image forming apparatus 100 of the present embodiment has a wide range of productivity of 35 to 70 ppm. Thus, the image forming apparatus 100 can form an image at any one of a plurality of process speeds, with a single hardware configuration. In addition, there is a case in which a plurality of image forming apparatuses having different process speeds use respective developing apparatuses having an identical configuration. In this case, if an image forming apparatus has a high process speed, the developing sleeve of the developing apparatus and each conveyance screw also have high rotational speeds.

In particular, if the second conveyance screw 22*b* has a high rotational speed, the developer may be stirred and thrown up by the second conveyance screw 22*b* even though the surface of the developer of the agitating chamber 21*b* falls. As a result, the developer may flow over the second spiral portion 302, and may be excessively discharged. For example, the second conveyance screw 22*b* rotates at a high speed of 700 rpm when achieving 70 ppm, and at a low speed of 350 rpm when achieving 35 ppm. Thus, in the present embodiment, the second conveyance screw 22*b* is configured as described below.

Figure 6:
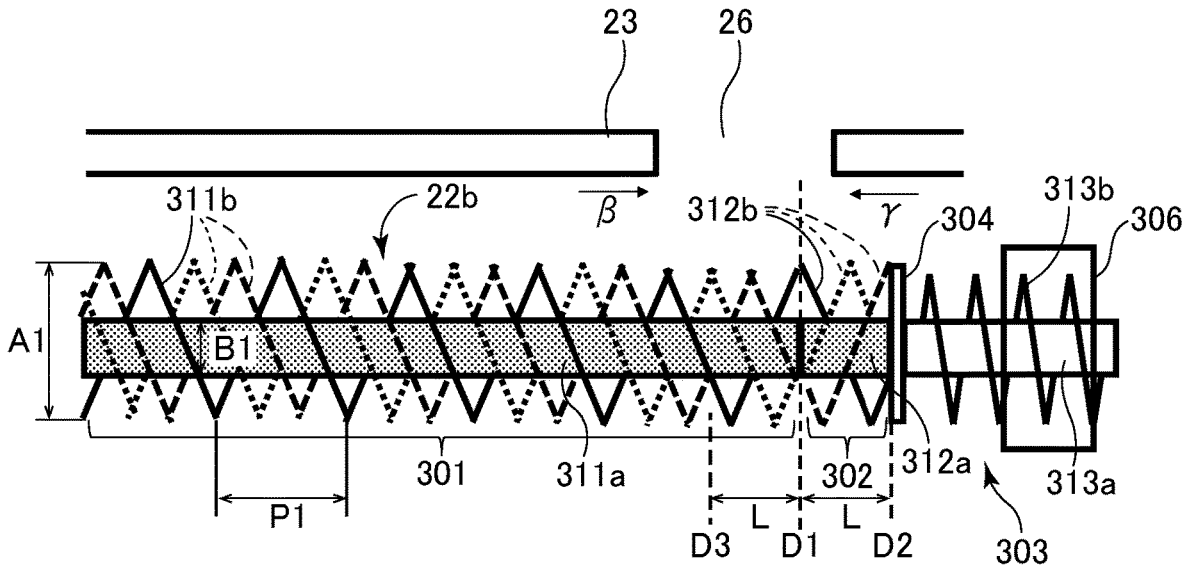
FIG. 6 is a schematic diagram of a second conveyance screw of the first embodiment.

With reference to FIG. 6, a detailed configuration of the second conveyance screw 22*b* will be described. As previously described, the second conveyance screw 22*b* includes the first spiral portion 301, the second spiral portion 302, and the third spiral portion 303. In the present embodiment, the conveyance force of the second spiral portion 302 is equal to or larger than the conveyance force of the first spiral portion 301 for preventing the developer from being excessively discharged even when the second conveyance screw 22*b* has a high rotational speed as described above. Note that the conveyance force of the first spiral portion 301 is applied against the conveyance force of the second spiral portion 302.

As illustrated in FIG. 6, the second spiral portion 302 is disposed between a first position D1 and a second position D2. As described above, the first position D1 faces the first communicating opening 26 at a position positioned downstream from the first spiral portion 301 in the forward direction (indicated by an arrow β). In addition, the first position D1 is positioned at an end portion of the second spiral portion 302 on the upstream side in the forward direction. On the other hand, the second position D2 is positioned upstream from the outlet 306 in the forward direction, and is positioned at an end portion of the second spiral portion 302 on the downstream side in the forward direction.

The distance between the first position D1 and the second position D2 is denoted by L. In the present embodiment, the distance L corresponds to the length of the second spiral portion 302 in the rotation-axis direction. That is, the distance L represents the length of a reverse conveyance area. In the reverse conveyance area, the second spiral portion 302 exerts the conveyance force for delivering the developer from the agitating chamber 21*b* to the developing chamber 21*a* through the first communicating opening 26 in cooperation with the first spiral portion 301. A third position D3 is positioned upstream from the first position D1 in the forward direction, and separated from the first position D1 by the distance L. That is, the third position D3 and the second position D2 are symmetric with respect to the first position D1. In the present embodiment, a portion of the first spiral portion 301 extending from an end portion of the first spiral portion 301 on the downstream side in the forward direction, toward upstream in the forward direction by the distance L is positioned between the first position D1 and the third position D3.

The absolute value of the sum of conveyance forces applied in a portion of the developer between the first position D1 and the third position D3 to convey the developer in the forward direction is denoted by F1. That is, the conveyance force F1 is part of the conveyance force of the first spiral portion 301 (the developer is conveyed by the conveyance force), and is applied in the portion of the first spiral portion 301 which is immediately in front of the second spiral portion 302 and which has the length of L. In addition, the absolute value of the sum of conveyance forces applied in the second spiral portion 302 to convey the developer in the reverse direction (indicated by an arrow γ) is denoted by F2. In this case, the second conveyance screw 22*b* is configured so as to satisfy the relationship of F1≤F2. Note that F1 and F2 are compared with each other in absolute value because they are applied in opposite directions.

As described above, the conveyance force F1 of the first spiral portion 301 is defined as a conveyance force of the portion of the first spiral portion 301 that has the same length as the length L of the second spiral portion 302. The reason is as follows. The conveyance force in a direction in which the developer is pushed toward the second spiral portion 302 is applied in the predetermined portion of the first spiral portion 301 that is immediately in front of the second spiral portion 302. Thus, the predetermined portion of the first spiral portion 301 exerts the conveyance force for delivering the developer from the agitating chamber 21*b* to the developing chamber 21*a* through the first communicating opening 26 in cooperation with the second spiral portion 302. However, the conveyance force of the other portion of the first spiral portion 301 on the upstream side in the forward direction hardly pushes the developer toward the second spiral portion 302. This is because even if the conveyance force of the other portion changes, the change in the conveyance force is generally applied to the surface of the developer.

Thus, in the present embodiment, the predetermined portion of the first spiral portion 301 that is immediately in front of the second spiral portion 302 has the same length as the length L of the second spiral portion 302. In addition, the conveyance force F2 of the second spiral portion 302 is equal to or larger than the conveyance force F1 of the predetermined portion of the first spiral portion 301. Preferably, the conveyance force F2 is equal to or larger than the conveyance force F 1 and equal to or smaller than the conveyance force F1 multiplied by 1.5 (F1≤F2≤1.5×F1). More preferably, the conveyance force F2 is larger than the conveyance force F1 and equal to or smaller than the conveyance force F1 multiplied by 1.3 (F1<F2≤1.3×F1).

Next, the relationship between the first spiral portion 301 and the second spiral portion 302 will be more specifically described. As described above, the first spiral portion 301 includes the first rotation shaft 311*a*, and the first blade portion 311*b* spirally formed on the first rotation shaft 311*a*. In the present embodiment, the number of threads of the first blade portion 311*b* is three. That is, the first spiral portion 301 is a triple thread screw. On the other hand, the second spiral portion 302 includes the second rotation shaft 312*a*, and the second blade portion 312*b* spirally formed on the second rotation shaft 312*a*. In the present embodiment, the number of threads of the second blade portion 312*b* is also three. That is, the second spiral portion 302 is also a triple thread screw.

The outer diameter of the first blade portion 311*b* is denoted by A1, the outer diameter of the first rotation shaft 311*a* is denoted by B1, the spiral lead of the first blade portion 311*b* is denoted by P1, and the number of threads of the first blade portion 311*b* is denoted by N1. In addition, the outer diameter of the second blade portion 312*b* is denoted by A2, the outer diameter of the second rotation shaft 312*a* is denoted by B2, the spiral lead of the second blade portion 312*b* is denoted by P2, and the number of threads of the second blade portion 312*b* is denoted by N2. In FIG. 6, although the symbols A1, B1, and P1 are illustrated, the symbols A2, B2, and P2 are omitted. In this case, the conveyance forces F1 and F2 are expressed by the following equations.

$$F1=(A1-B1)\times P1\times N1\times L$$

$$F2=(A2-B2)\times P2\times N2\times L$$

Thus, in the present embodiment, the relationship between F1 and F2 is expressed by the following expression.

$$(A1-B1)\times P1\times N1\times L\leq(A2-B2)\times P2\times N2\times L \quad (1)$$

If both sides are divided by L, the following expression is obtained.

$$(A1-B1)\times P1\times N1\leq(A2-B2)\times P2\times N2$$

When F2 is equal to or smaller than F1 multiplied by 1.5, the following expression is satisfied.

$$(A1-B1)\times P1\times N1\leq(A2-B2)\times P2\times N2\leq 1.5\times(A1-B1)\times P1\times N1$$

When F2 is equal to or smaller than F1 multiplied by 1.3, the following expression is satisfied.

$$(A1-B1)\times P1\times N1\leq(A2-B2)\times P2\times N2\leq 1.3\times(A1-B1)\times P1\times N1$$

Note that the first spiral portion 301 and the second spiral portion 302 may be single thread screws, or multiple thread screws other than the triple thread screws. In addition, the number of threads of the first blade portion 311*b* may or may not be equal to the number of threads of the second blade portion 312*b*. For example, the number of threads of the first blade portion 311*b* may be one or two, and the number of threads of the second blade portion 312*b* may be one or two. In addition, the outer diameter and the pitch of the first blade portion 311*b* may or may not be equal to those of the second blade portion 312*b*, and the outer diameter of the first rotation shaft 311*a* may or may not be equal to the outer diameter of the second rotation shaft 312*a*. In short, any parameters are available as long as the above-described relationship of F1≤F2 is satisfied.

Next, the above-described expression (1) will be described. The left side of the expression (1) expresses the conveyance force F1 of the first spiral portion 301 required to convey the developer to the first position D1 (reverse conveyance point) in the forward direction.

The difference between the outer diameter A1 of the first blade portion 311*b* and the outer diameter (shaft diameter) B1 of the first rotation shaft 311*a* relates to the area of the spiral blade. Thus, the conveyance force increases as the difference increases. The spiral pitch P1 relates to a distance by which the developer is conveyed while the second conveyance screw 22*b* makes one revolution. Thus, the conveyance force increases as the spiral pitch P1 increases. The number N1 of threads of the spiral is proportional to the number of times in which the developer abuts against the reverse conveyance point while the second conveyance screw 22*b* makes one revolution (the developer is conveyed while caught in the spiral blade). Thus, the conveyance force increases as the number N1 of threads of the spiral increases. Furthermore, both sides of the expression (1) are multiplied by L for comparing the conveyance force F2 of the second spiral portion 302 with the conveyance force F1 of the portion of the first spiral portion 301 that has the length of the second spiral portion 302, that is, the length L of the reverse conveyance area.

Similarly, the right side of the expression (1) expresses the conveyance force F2 of the second spiral portion 302 required to convey the developer to the first position D1 (reverse conveyance point) in the reverse direction.

The difference between the outer diameter A2 of the second blade portion 312*b* and the outer diameter (shaft diameter) B2 of the second rotation shaft 312*a* relates to the area of the spiral blade. Thus, the conveyance force increases as the difference increases. The spiral pitch P2 relates to a distance by which the developer is conveyed while the second conveyance screw 22*b* makes one revolution. Thus, the conveyance force increases as the spiral pitch P2 increases. The number N2 of threads of the spiral is proportional to the number of times in which the developer abuts against the reverse conveyance point while the second conveyance screw 22*b* makes one revolution (the developer is conveyed while caught in the spiral blade). Thus, the conveyance force increases as the number N2 of threads of the spiral increases. Furthermore, both sides of the expression (1) are multiplied by L for evaluating the reverse conveyance force of the second spiral portion 302 whose length is the length L of the reverse conveyance area.

As described above, the conveyance force F2 in the reverse direction expressed by the right side of the expression (1) is equal to or larger than the conveyance force F1 in the forward direction expressed by the left side of the expression (1). With this relationship, the developer can be prevented from being excessively discharged even when the image forming apparatus has a high process speed. That is, even when the image forming apparatus has a high process speed, the amount of discharged developer can be optimized.

Specifically, the developing apparatus of the present embodiment has the following parameters. The outer diameter A1 of the first blade portion 311*b* is 14 mm, the outer diameter B1 of the first rotation shaft 311*a* is 6 mm, the spiral pitch P1 of the first blade portion 311*b* is 20 mm, and the number N1 of threads of the spiral is 3. On the other hand, the outer diameter A2 of the second blade portion 312*b* is 14 mm, the outer diameter B2 of the second rotation shaft 312*a* is 6 mm, the spiral pitch P2 of the second blade portion 312*b* is 25 mm, the number N2 of threads of the spiral is 3, and the length L of the reverse conveyance area is 15 mm. Note that the configuration to which the present embodiment can be applied may not have the above-described parameters, and may have any parameters as long as the expression (1) is satisfied.

Example 1

For confirming the effect of the present embodiment, an experiment was conducted, and the result was compared with Comparative Examples 1 to 3 in terms of whether the developer is prevented from being excessively discharged when the rotational speed of the second conveyance screw 22*b* is varied. Hereinafter, the detailed description thereof will be made.

For evaluating the amount of discharged developer, the minimum amount of developer of the developer container was set at 150 g, and the amount of developer discharged from the outlet 306 per second was measured in a state where the developing apparatus was run idle without the supply of developer. The idling run is an operation of the developing apparatus in which the developing sleeve and each screw of the developing apparatus are rotated in a state where the developing apparatus develops no toner image. The minimum amount of developer is required to achieve a target quality of images such as a target uniformity in in-plane density, and varies depending on the configuration of the developing apparatus and the target quality of images.

Next, the minimum amount of toner consumed per unit time for forming a control patch image was calculated, and the amount of carrier supplied together with toner having the minimum amount was calculated. In the present embodiment, the control patch image is formed every time a predetermined number of sheets is outputted, for keeping a constant image density and supplying toner to the cleaners 109Y to 109K as lubricant. The calculated amount of carrier supplied together with the toner having the minimum amount was 0.1 mg per second. The amount of carrier also varies, depending on the configuration of the image forming apparatus and the target quality of images.

Then, the amount of developer discharged per second was compared with the minimum amount 0.1 mg of carrier supplied per second, in a state where the developing apparatus was run idle with the minimum amount of developer of 150 g required to keep the constant image quality. If the amount of discharged developer is larger than the amount of supplied carrier in the idling run, the amount of developer of the developing apparatus obtained when the image forming apparatus is actually used may be smaller than 150 g. In this case, the evaluation result is indicated by a symbol "NG". Otherwise, the evaluation result is indicated by a symbol "OK". That is, the evaluation result is indicated by the symbol "NG" if it was judged that the developer was excessively discharged, or by the symbol "OK" if not.

FIG. 7 illustrates the result of the experiment. In the experiment, Example 1 that satisfies the expression (1) and Comparative Examples 1 to 3 that do not satisfy the expression (1) were conducted. In Comparative Examples 1 to 3, only the parameters of the second spiral portion 302 were changed, unlike Example 1.

As described above, the image forming apparatus including the developing apparatus of the present embodiment has a wide range of productivity from 35 to 70 ppm. Thus, when the image forming apparatus operates at 70 ppm, the second conveyance screw 22*b* rotates at a high speed of 700 rpm. When the image forming apparatus operates at 35 ppm, the second conveyance screw 22*b* rotates at a low speed of 350 rpm.

As illustrated in the table of FIG. 7, in Example 1, even when the process speed was high (70 ppm), the amount of developer of the developing apparatus was not less than 150 g. Thus, in Example 1, the developer can be prevented from being excessively discharged even when the process speed is high. On the other hand, in Comparative Examples 1 to 3, when the process speed was high (70 ppm), the amount of developer of the developing apparatus was less than 150 g. Thus, in Comparative Examples 1 to 3, the developer is excessively discharged when the process speed is high.

As described above, in Comparative Examples 1 to 3, only the parameters of the second spiral portion 302 were changed, unlike Example 1. This is because the first spiral portion 301 is required to properly agitate and convey the supplied toner and the developer, and thus has a fixed configuration to achieve its agitating-and-conveying function. For this reason, it is preferable to change the configuration of the second spiral portion 302 for preventing the developer from being excessively discharged and for achieving the reliable operation of the ACR system.

As described above, in the present embodiment, the developer can be prevented from being excessively discharged and the change in the amount of developer can be suppressed even when the process speed is high.

Second Embodiment

Figure 8:
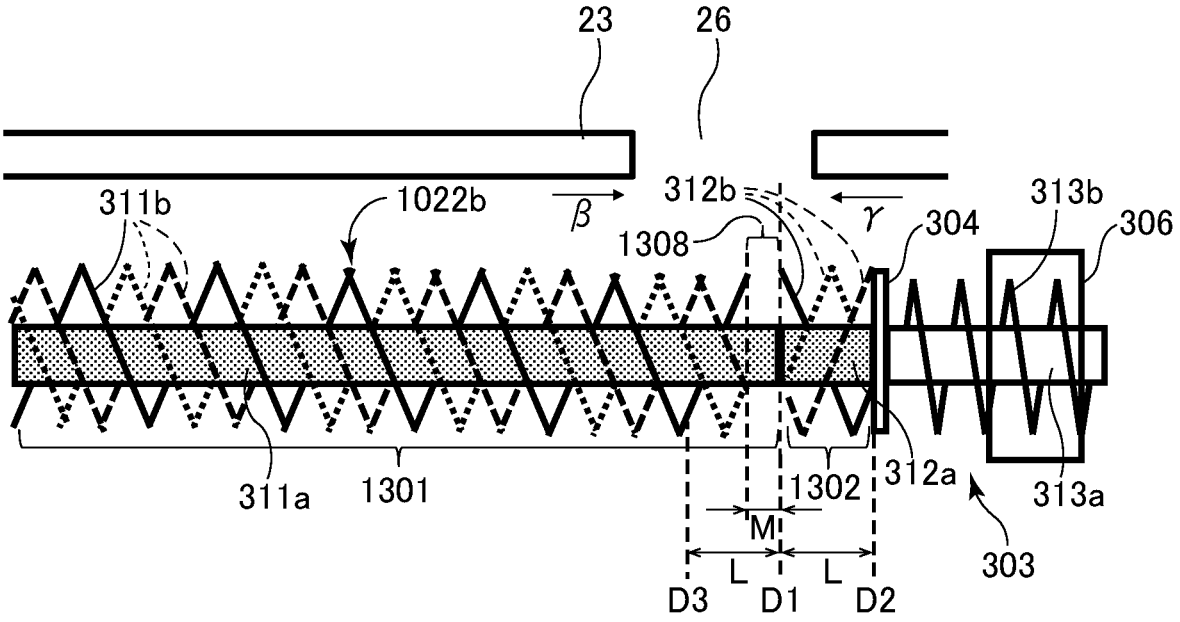
FIG. 8 is a schematic diagram of a second conveyance screw of a second embodiment.

A second embodiment will be described with reference to FIG. 8. In the present embodiment, unlike the first embodiment, a first spiral portion 1301 of a second conveyance screw (second conveyance member) 1022*b* has a clearance portion 1308 formed immediately in front of a second spiral portion 1302. Since the other configuration and operation are the same as those of the first embodiment, a component identical to a component of the first embodiment is given an identical symbol, duplicated description and illustration will be omitted or simplified, and features different from the first embodiment will be mainly described below.

In the present embodiment, a joining portion between the first spiral portion (forward-direction conveyance portion) 1301 and the second spiral portion (reverse-direction conveyance portion) 1302 has only the rotation shaft of the conveyance screw without the spiral blade. Hereinafter, the joining portion is referred to as the clearance portion 1308. That is, the first spiral portion 1301 includes the first rotation shaft 311*a*, the first blade portion 311*b* spirally formed on the first rotation shaft 311*a*, and the clearance portion 1308 that serves as a blade-free portion having no spiral blade formed on the first rotation shaft 311*a*. The clearance portion 1308 is a portion of the first spiral portion 1301, and has no spiral blade formed on the outer circumferential surface of the first rotation shaft 311*a*. In addition, the clearance portion 1308 extends from an end of the second blade portion 312*b* on the upstream side in the forward direction (indicated by an arrow β) toward the reverse direction (indicated by an arrow γ). Furthermore, the clearance portion 1308 is disposed in a range of L, which denotes the length of the second blade portion 312*b* in the rotation-axis direction.

The reason that the clearance portion 1308 is provided is as follows. That is, if the spiral blade of the first spiral portion 1301 and the spiral blade of the second spiral portion 1302 are joined with each other, the developer may be thrown up in the joining portion and excessively discharged. However, since the clearance portion 1308 prevents the spiral blade of the first spiral portion 1301 and the spiral blade of the second spiral portion 1302 from being joined with each other in the joining portion, the developer can be prevented from being thrown up in the joining portion and excessively discharged.

However, in an experiment conducted by the present inventor, there was a case in which only providing the clearance portion did not prevent the developer from being excessively discharged when the process speed was high. Thus, in the present embodiment, the developer is prevented from being excessively discharged even when the process speed is high, by providing the following configuration.

Also in the present embodiment, as in the first embodiment, the second spiral portion 1302 is disposed between the first position D1 and the second position D2. In addition, the distance between the first position D1 and the second position D2 is denoted by L, and the third position D3 is positioned upstream from the first position D1 in the forward direction (indicated by the arrow β) and separated from the first position D1 by the distance L. In the present embodiment, a portion of the first spiral portion 1301 extending from an end portion of the first spiral portion 301 on the downstream side in the forward direction, toward upstream by the distance L is located between the first position D1 and the third position D3. The portion of the first spiral portion 1301 between the position D1 and the position D3 includes one portion of the first blade portion 311*b* on the downstream side in the forward direction and the clearance portion 1308.

The absolute value of the sum of conveyance forces applied in the portion between the first position D1 and the third position D3 to convey the developer in the forward direction is denoted by F1. Since the conveyance force is zero in the clearance portion 1308 that has no spiral blade, the conveyance force F1 is produced by the one portion of the first blade portion 311*b* formed between the position D1 and the position D3. In addition, the absolute value of the sum of conveyance forces applied in the second spiral portion 1302 to convey the developer in the reverse direction (indicated by the arrow γ) is denoted by F2. In this case, also in the present embodiment, the second conveyance screw 1022*b* is configured so as to satisfy the relationship of $F1 \leq F2$.

Next, the relationship between the first spiral portion 1301 and the second spiral portion 1302 will be more specifically described. The outer diameter of the first blade portion 311*b* is denoted by A1, the outer diameter of the first rotation shaft 311*a* is denoted by B1, the spiral lead of the first blade portion 311*b* is denoted by P1, the number of threads of the first blade portion 311*b* is denoted by N1, and the length of the clearance portion 1308 in the rotation-axis direction is denoted by M. In addition, the outer diameter of the second blade portion 312*b* is denoted by A2, the outer diameter of the second rotation shaft 312*a* is denoted by B2, the spiral lead of the second blade portion 312*b* is denoted by P2, and the number of threads of the second blade portion 312*b* is denoted by N2. In this case, the conveyance forces F1 and F2 are expressed by the following equations.

$$F1=(A1-B1)\times P1\times N1\times(L-M)$$

$$F2=(A2-B2)\times P2\times N2\times L$$

Thus, in the present embodiment, the relationship between F1 and F2 is expressed by the following expression.

$$(A1-B1)\times P1\times N1\times(L-M)\leq(A2-B2)\times P2\times N2\times L \quad (2)$$

Also in the present embodiment, the first spiral portion 1301 and the second spiral portion 1302 are triple thread screws. Note that the first spiral portion 1301 and the second spiral portion 1302 may be single thread screws, or multiple thread screws other than the triple thread screws. In addition, the number of threads of the first blade portion 311*b* may or may not be equal to the number of threads of the second blade portion 312*b*. For example, the number of threads of the first blade portion 311*b* may be one or two, and the number of threads of the second blade portion 312*b* may be one or two. In addition, the outer diameter and pitch of the first blade portion 311*b* may or may not be equal to those of the second blade portion 312*b*, and the outer diameter of the first rotation shaft 311*a* may or may not be equal to the outer diameter of the second rotation shaft 312*a*. In short, any parameters are available as long as the above-described relationship of F1≤F2 is satisfied. Also in the present embodiment, the conveyance force F2 is preferably equal to or larger than the conveyance force F1 and equal to or smaller than the conveyance force F1 multiplied by 1.5 (F1≤F2≤1.5×F1). More preferably, the conveyance force F2 is larger than the conveyance force F1 and equal to or smaller than the conveyance force F1 multiplied by 1.3 (F1≤F2≤1.3×F1).

The expression (2) has substantially the same meaning as that of the expression (1) of the first embodiment. However, unlike the first embodiment, the clearance portion 1308 is provided in the present embodiment. The clearance portion 1308 reduces the developer conveyance force applied in the forward direction, or does not resist the developer conveyance force applied in the reverse direction.

Thus, as expressed by the expression (2), the developer conveyance force in the forward direction is calculated by subtracting the length M of the clearance portion 1308 from the length L of the reverse conveyance area, and by performing multiplication on the resultant value. As can be understood, the conveyance force F 1 applied at the first position (reverse conveyance point) D1 in the forward direction is weakened by a value corresponding to the clearance portion 1308.

Specifically, the developing apparatus of the present embodiment has following parameters. The outer diameter A1 of the first blade portion 311*b* is 14 mm, the outer diameter B1 of the first rotation shaft 311*a* is 6 mm, the spiral pitch P1 of the first blade portion 311*b* is 30 mm, the number N1 of threads of the spiral is 3, and the length M of the clearance portion 1308 is 3 mm. On the other hand, the outer diameter A2 of the second blade portion 312*b* is 14 mm, the outer diameter B2 of the second rotation shaft 312*a* is 6 mm, the spiral pitch P2 of the second blade portion 312*b* is 30 mm, the number N2 of threads of the spiral is 3, and the length L of the reverse conveyance area is 25 mm. Note that the configuration to which the present embodiment can be applied may not have the above-described parameters, and may have any parameters as long as the expression (2) is satisfied. In addition, the number of threads of each blade portion may be changed in the blade portion. For example, the number of threads of the first blade portion 311*b* may be two in one portion of the first blade portion 311*b* formed between the first position D1 and the third position D3, and may be three in the other portion of the first blade portion 311*b* located upstream from the one portion in the forward direction.

Second Example

For confirming the effect of the present embodiment, an experiment was conducted in the same manner as the experiment of Example 1, and the result was compared with Comparative Examples 4 to 6 in terms of whether the developer is prevented from being excessively discharged when the rotational speed of the second conveyance screw 1022*b* is varied. The method of the experiment and the evaluation is the same as that in Example 1.

FIG. 9 illustrates the result of the experiment. In the experiment, Example 2 that satisfies the expression (2) and Comparative Examples 4 to 6 that do not satisfy the expression (2) were conducted. The image forming apparatus including the developing apparatus of the present embodiment has a wide range of productivity from 45 to 90 ppm. Thus, when the image forming apparatus operates at 90 ppm, the second conveyance screw 1022*b* rotates at a high speed of 900 rpm; when the image forming apparatus operates at 45 ppm, the second conveyance screw 1022*b* rotates at a low speed of 450 rpm.

As illustrated in the table of FIG. 9, in Example 2, even when the process speed was high (90 ppm), the amount of developer of the developing apparatus was not less than 150 g. Thus, in Example 2, the developer can be prevented from being excessively discharged even when the process speed is high. On the other hand, in Comparative Examples 4 to 6, when the process speed was high (90 ppm), the amount of developer of the developing apparatus was less than 150 g. Thus, in Comparative Examples 4 to 6, the developer is excessively discharged when the process speed is high.

As described above, in the present embodiment, the developer can be prevented from being excessively discharged and the change in the amount of developer can be suppressed even when the process speed is high.

OTHER EMBODIMENTS

Figure 10A:
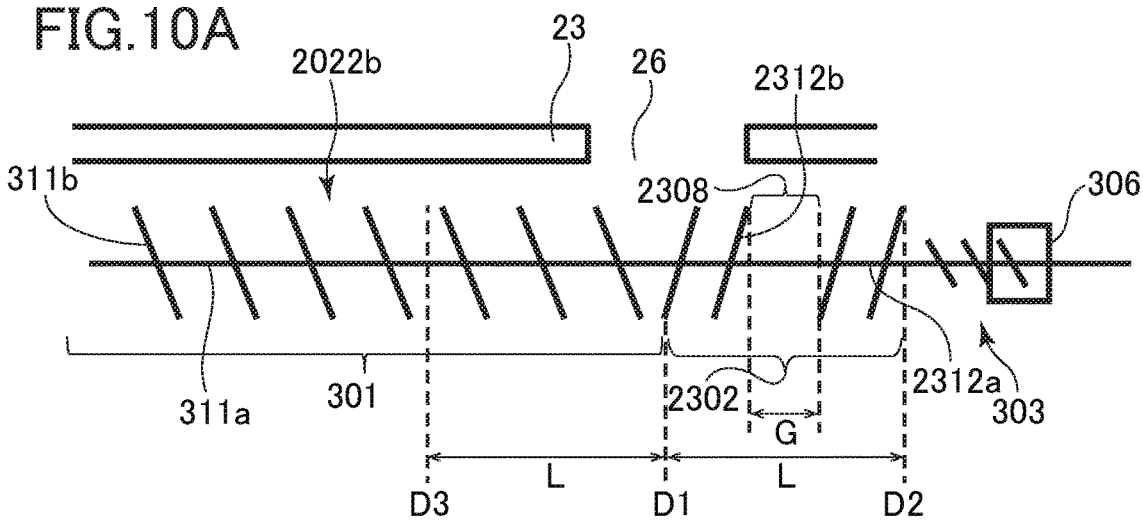
FIG. 10A is a schematic diagram of a second conveyance screw of a first example of another embodiment.

In the above-described embodiments, the second spiral portion, which serves as a reverse-direction conveyance portion, has the spiral blade formed in an identical direction in the whole of the second spiral portion having the length of L. The second spiral portion, however, is not limited to this. For example, as illustrated in FIG. 10A, a second spiral portion (reverse-direction conveyance portion) 2302 of a second conveyance screw (second conveyance member) 2022*b* may include a clearance portion (blade-free portion) 2308 that has no blade formed on a second rotation shaft 2312*a*. In this case, the conveyance force F2 of the second spiral portion 2302 is produced by the second blade portion 2312*b*.

As an example, the outer diameter of the second blade portion 2312*b* is denoted by A2, the outer diameter of the second rotation shaft 2312*a* is denoted by B2, the spiral pitch of the second blade portion 2312*b* is denoted by P2, and the number of threads of the second blade portion 2312*b* is denoted by N2. In addition, the length of the clearance portion 2308 in the rotation-axis direction is denoted by G. In this case, the conveyance force F2 is expressed by the following equation.

$$F2=[(A2-B2)\times P2\times N2\times(L-G)]+[(B2-B2)\times P2\times N2\times G]$$

The term of [(A2−B2)×P2×N2×(L−G)] of the right side of the above equation represents the conveyance force produced by the second blade portion 2312*b*. In addition, the term [(B2−B2)×P2×N2×G] represents the conveyance force produced by the clearance portion 2308. Since the clearance portion 2308 has no blade, B2−B2=0, and the conveyance force becomes zero. Thus, the conveyance force F2 is produced by the second blade portion 2312*b*, as expressed by the following equation.

$$F2=(A2-B2)\times P2\times N2\times(L-G)$$

Figure 10B:
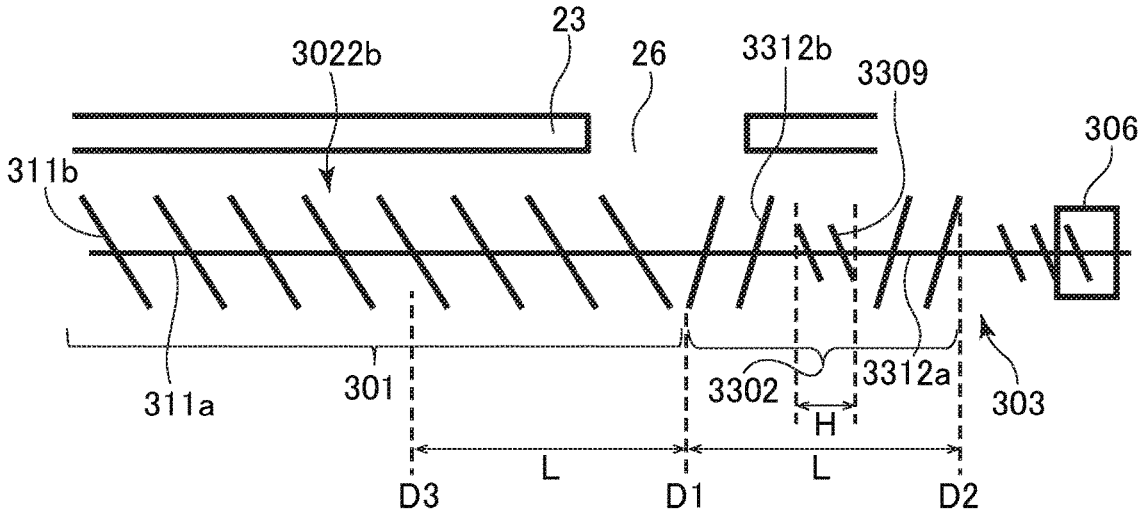
FIG. 10B is a schematic diagram of a second conveyance screw of a second example of the other embodiment.

In addition, as illustrated in FIG. 10B, a second spiral portion (reverse-direction conveyance portion) 3302 of a second conveyance screw (second conveyance member) 3022*b* may include a reverse-direction blade portion 3309 that conveys the developer in a direction opposite to the direction in which a second blade portion 3312*b* conveys the developer. The second blade portion 3312*b* is formed in a direction that allows the developer to be conveyed toward the first spiral portion 301, whereas the reverse-direction blade portion 3309 is formed in a direction opposite to the direction in which the second blade portion 3312*b* is formed, that is, in a direction that allows the developer to be conveyed toward the outlet 306. In this case, the conveyance force F2 of the second spiral portion 3302 is obtained by subtracting the conveyance force of the reverse-direction blade portion 3309 from the conveyance force of the second blade portion 3312*b*.

As an example, the outer diameter of the second blade portion 3312*b* is denoted by A2, the outer diameter of the second rotation shaft 3312*a* is denoted by B2, the spiral pitch of the second blade portion 3312*b* is denoted by P2, and the number of threads of the second blade portion 3312*b* is denoted by N2. In addition, the outer diameter of the reverse-direction blade portion 3309 is denoted by A3, the spiral pitch of the reverse-direction blade portion 3309 is denoted by P3, the number of threads of the reverse-direction blade portion 3309 is denoted by N3, and the length of the reverse-direction blade portion 3309 in the rotation-axis direction is denoted by H. In this case, the conveyance force F2 is expressed by the following equation.

$$F2=[(A2-B2)\times P2\times N2\times(L-H)]-[(A3-B2)\times P3\times N3\times H]$$

Figure 10C:
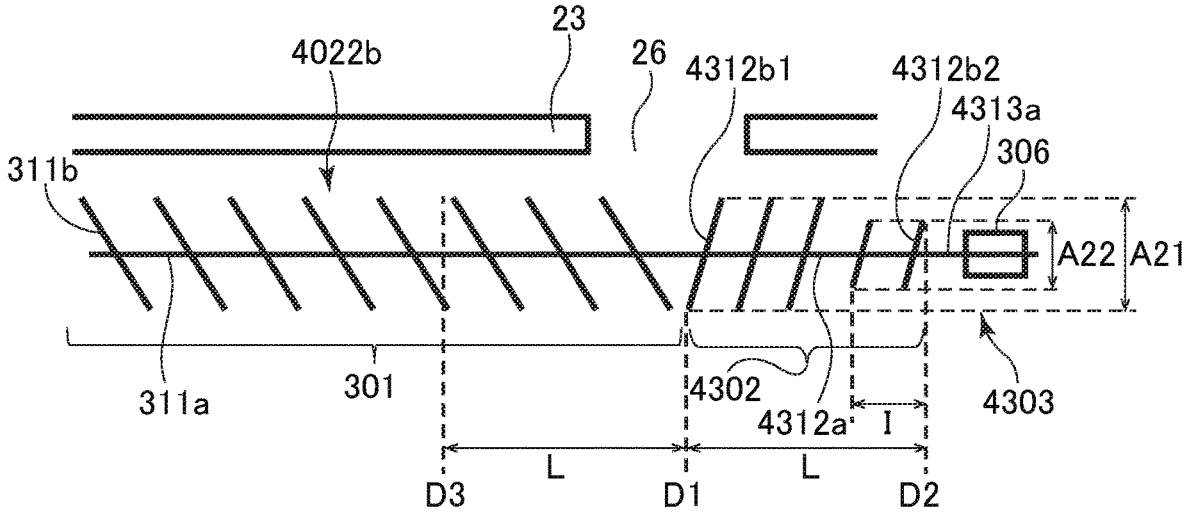
FIG. 10C is a schematic diagram of a second conveyance screw of a third example of the other embodiment.

Furthermore, as illustrated in FIG. 10C, a second spiral portion (reverse-direction conveyance portion) 4302 of a second conveyance screw (second conveyance member) 4022*b* may include second blade portions 4312*b*1 and 4312*b*2 whose outer diameters are different from each other. In this case, the conveyance force F2 is the sum of the conveyance forces of the second blade portions 4312*b*1 and 4312*b*2.

As an example, the outer diameter of the second blade portion 4312*b*1 is denoted by A21, the outer diameter of a second rotation shaft 4312*a* is denoted by B2, the spiral pitch of the second blade portion 4312*b*1 is denoted by P21, and the number of threads of the second blade portion 4312*b*1 is denoted by N21. In addition, the outer diameter of the second blade portion 4312*b*2 is denoted by A22, the spiral pitch of the second blade portion 4312*b*2 is denoted by P22, and the number of threads of the second blade portion 4312*b*2 is denoted by N22. Furthermore, the length of the second blade portion 4312*b*2 in the rotation-axis direction is denoted by I. In this case, the conveyance force F2 is expressed by the following equation.

$$F2=[(A21-B2)\times P21\times N21\times(L-I)]+[(A22-B2)\times P22\times N22\times I]$$

In the configuration illustrated in FIG. 10C, an introduction portion 4303 is disposed instead of the third spiral portion. The introduction portion 4303 has no blade formed on a third rotation shaft 4313*a*, and is disposed downstream from the second spiral portion 4302 in the forward direction. That is, the portion between the second spiral portion 4302 and the outlet 306 may have no blade. In short, the portion between the second spiral portion 4302 and the outlet 306 may have any configuration as long as the portion does not convey the developer in the reverse direction (opposite to the forward direction), in which the second spiral portion 4302 conveys the developer. In the configuration illustrated in FIG. 10C, the developer that flows over the second spiral portion 4302 flows directly into the outlet 306 (without being conveyed). The introduction portion 4303 may be applied to the first embodiment, the second embodiment, the configuration of FIG. 10A, or the configuration of FIG. 10B.

As described above, the reverse-direction conveyance portion of the present invention may include a portion that conveys the developer in the forward direction, or a portion that has no conveyance force. In other words, the reverse-direction conveyance portion extends from a start point to an end point in the forward direction. The start point is a point at which the reverse-direction conveyance force starts to be produced, and the end point is a point at which the reverse-direction conveyance force disappears. Consequently, at any point located downstream from an end (end point) of the reverse-direction conveyance portion on the downstream side in the forward direction, there is no conveyance force that conveys the developer in the reverse direction. Thus, at any point located downstream from the end point of the reverse-direction conveyance portion in the forward direction, any conveyance force may be produced in the forward direction, or may not be produced.

As described above, the force F2 is the absolute value of the sum of conveyance forces of the second spiral portion. Thus, if one force is applied in the second spiral portion to convey the developer in a direction opposite to the direction in which the second blade portion conveys the developer, the one force is subtracted from the force F2; if one portion of the second spiral portion has no blade, the conveyance force of the one portion is zero and is not added to the conveyance force F2. In addition, if one portion of the second blade portion has an outer diameter different from that of the other portion of the second blade portion, or if one portion of the second rotation shaft has an outer diameter different from that of the other portion of the second blade portion, the conveyance force F2 is obtained by calculating the conveyance force of the one portion by using the above-described equations, and by totalizing all the conveyance forces applied in the portion between the first position D1 and the second position D2. The same holds true for the first spiral portion (forward-direction conveyance portion). That is, the conveyance force F1 is obtained by totalizing all the conveyance forces applied in the portion between the first position D1 and the third position D3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-091657, filed May 14, 2019, which is hereby incorporated by reference herein in its entirety.

What is claimed is:

1. A developing apparatus comprising:

a developer bearing member configured to bear developer containing toner and carrier for developing an electrostatic latent image formed on an image bearing member;

a developer container comprising a first chamber and a second chamber and configured to contain the developer, the second chamber being separated from the first chamber by a partition wall;

a first communicating portion configured to permit the developer to communicate from the second chamber to the first chamber;

a second communicating portion configured to permit the developer to communicate from the first chamber to the second chamber;

a first conveyance screw disposed in the first chamber and configured to convey the developer in a first direction toward the second communicating portion from the first communicating portion;

a second conveyance screw disposed in the second chamber and comprising:

a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, and a second blade portion disposed downstream of the first blade portion in the second direction, spirally formed on an outer circumferential surface of the second rotation shaft portion, and configured to convey the developer in the first direction and deliver the developer from the second chamber to the first chamber through the first communicating portion, each of the first blade portion and the second blade portion being disposed in the second direction so as to face the first communicating portion; and a developer discharging portion disposed downstream of the second blade portion in the second direction and configured to discharge a part of the developer from the developing apparatus, wherein the number of threads of the second blade portion is three, and wherein the developing apparatus satisfies a following expression:

$$(A1-B1)\times P1\times N1\leq(A2-B2)\times P2\times N2\leq 1.5\times(A1-B1)\times P1\times N1$$

where A1 is an outer diameter of the first blade portion, B1 is an outer diameter of the first rotation shaft portion, P1 is a spiral lead of the first blade portion, N1 is a number of threads of the first blade portion, A2 is an outer diameter of the second blade portion, B2 is an outer diameter of the second rotation shaft portion, P2 is a spiral lead of the second blade portion, and N2 is a number of threads of the second blade portion, and wherein N2 equals three.

2. The developing apparatus according to claim 1, wherein the developing apparatus satisfies a following expression:

$$(A1-B1)\times P1\times N1\leq(A2-B2)\times P2\times N2\leq 1.3\times(A1-B1)\times P1\times N1.$$

3. The developing apparatus according to claim 1, wherein the spiral lead of the first blade portion is equal to the spiral lead of the second blade portion.

4. The developing apparatus according to claim 1, wherein the outer diameter of the first blade portion is equal to the outer diameter of the second blade portion.

5. The developing apparatus according to claim 1, wherein the outer diameter of the first rotation shaft portion is equal to the outer diameter of the second rotation shaft portion.

6. The developing apparatus according to claim 1, wherein the number of threads of the first blade portion is three, and wherein N1 equals three.

7. The developing apparatus according to claim 1, wherein the developer is supplied to the developer bearing member in the first chamber.

8. A developing apparatus comprising:

a developer bearing member configured to bear developer containing toner and carrier for developing an electrostatic latent image formed on an image bearing member;

a developer container comprising a first chamber and a second chamber and configured to contain the developer, the second chamber being separated from the first chamber by a partition wall;

a first communicating portion configured to permit the developer to communicate from the second chamber to the first chamber;

a second communicating portion configured to permit the developer to communicate from the first chamber to the second chamber;

a first conveyance screw disposed in the first chamber and configured to convey the developer in a first direction toward the second communicating portion from the first communicating portion;

a second conveyance screw disposed in the second chamber and comprising:

a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, a second blade portion disposed downstream from the first blade portion in the second direction, spirally formed on an outer circumferential surface of the second rotation shaft portion, and configured to convey the developer in the first direction and deliver the developer from the second chamber to the first chamber through the first communicating portion, each of the first blade portion and the second blade portion being disposed in the second direction so as to face the first communicating portion, and a clearance portion having no spiral blade formed on the outer circumferential surface of the first rotation shaft portion and extending from an end of the second blade portion on an upstream side in the second direction toward the first direction, the clearance portion being disposed within a range of L, a length of the second blade portion in a rotation-axis direction being denoted by L; and a developer discharging portion disposed downstream of the second blade portion in the second direction and configured to discharge a part of the developer from the developing apparatus, wherein the developing apparatus satisfies a following expression:

$$(A1-B1)\times P1\times N1\times(L-M)\leq(A2-B2)\times P2\times N2\times L\leq 1.5\times(A1-B1)\times P1\times N1\times(L-M)$$

where M is a length of the clearance portion in the rotation-axis direction, A1 is an outer diameter of the first blade portion, B1 is an outer diameter of the first rotation shaft portion, P1 is a spiral lead of the first blade portion, N1 is a number of threads of the first blade portion, A2 is an outer diameter of the second blade portion, B2 is an outer diameter of the second rotation shaft portion, P2 is a spiral lead of the second blade portion, and N2 is a number of threads of the second blade portion.

9. The developing apparatus according to claim 8, wherein the developing apparatus satisfies a following expression:

$$(A1-B1)\times P1\times N1\times(L-M)\leq(A2-B2)\times P2\times N2\times L\leq 1.3\times(A1-B1)\times P1\times N1\times(L-M).$$

10. The developing apparatus according to claim 8, wherein the number of threads of the first blade portion is equal to the number of threads of the second blade portion.

11. The developing apparatus according to claim 8, wherein the spiral lead of the first blade portion is equal to the spiral lead of the second blade portion.

12. The developing apparatus according to claim 8, wherein the outer diameter of the first blade portion is equal to the outer diameter of the second blade portion.

13. The developing apparatus according to claim 8, wherein the outer diameter of the first rotation shaft portion is equal to the outer diameter of the second rotation shaft portion.

14. The developing apparatus according to claim 8, wherein the number of threads of the second blade portion is three, and wherein N2 equals three.

15. The developing apparatus according to claim 8, wherein the number of threads of the first blade portion is three, and wherein N1 equals three.

16. The developing apparatus according to claim 8, wherein the developer is supplied to the developer bearing member in the first chamber.

17. A developing apparatus comprising:

a developer bearing member configured to bear developer containing toner and carrier for developing an electrostatic latent image formed on an image bearing member;

a developer container comprising a first chamber and a second chamber and configured to contain the developer, the second chamber being separated from the first chamber by a partition wall;

a first communicating portion configured to permit the developer to communicate from the second chamber to the first chamber;

a second communicating portion configured to permit the developer to communicate from the first chamber to the second chamber;

a first conveyance screw disposed in the first chamber and configured to convey the developer in a first direction toward the second communicating portion from the first communicating portion;

a second conveyance screw disposed in the second chamber and comprising:

a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, and a second blade portion disposed downstream of the first blade portion in the second direction, spirally formed on an outer circumferential surface of the second rotation shaft portion, and configured to convey the developer in the first direction and deliver the developer from the second chamber to the first chamber through the first communicating portion, each of the first blade portion and the second blade portion being disposed in the second direction so as to face the first communicating portion; and a developer discharging portion disposed downstream of the second blade portion in the second direction and configured to discharge a part of the developer from the developing apparatus, wherein the number of threads of the first blade portion is three, and wherein the developing apparatus satisfies a following expression:

$$(A1-B1)\times P1\times N1\leq(A2-B2)\times P2\times N2$$

where A1 is an outer diameter of the first blade portion, B1 is an outer diameter of the first rotation shaft portion, P1 is a spiral lead of the first blade portion, N1 is a number of threads of the first blade portion, A2 is an outer diameter of the second blade portion, B2 is an outer diameter of the second rotation shaft portion, P2 is a spiral lead of the second blade portion, and N2 is a number of threads of the second blade portion, and wherein N1 equals three.

18. A developing apparatus comprising:

a developer bearing member configured to bear developer containing toner and carrier for developing an electrostatic latent image formed on an image bearing member;

a developer container comprising a first chamber and a second chamber and configured to contain the developer, the second chamber being separated from the first chamber by a partition wall;

a first communicating portion configured to permit the developer to communicate from the second chamber to the first chamber;

a second communicating portion configured to permit the developer to communicate from the first chamber to the second chamber;

a first conveyance screw disposed in the first chamber and configured to convey the developer in a first direction toward the second communicating portion from the first communicating portion;

a second conveyance screw disposed in the second chamber and comprising:

a first rotation shaft portion, a first blade portion spirally formed on an outer circumferential surface of the first rotation shaft portion and configured to convey the developer in a second direction opposite to the first direction, a second rotation shaft portion formed coaxially with the first rotation shaft portion, a second blade portion disposed downstream from the first blade portion in the second direction, spirally formed on an outer circumferential surface of the second rotation shaft portion, and configured to convey the developer in the first direction and deliver the developer from the second chamber to the first chamber through the first communicating portion, each of the first blade portion and the second blade portion being disposed in the second direction so as to face the first communicating portion, and a clearance portion having no spiral blade formed on the outer circumferential surface of the first rotation shaft portion and extending from an end of the second blade portion on an upstream side in the second direction toward the first direction, the clearance portion being disposed within a range of L, a length of the second blade portion in a rotation-axis direction being denoted by L; and a developer discharging portion disposed downstream of the second blade portion in the second direction and configured to discharge a part of the developer from the developing apparatus, wherein the developing apparatus satisfies a following expression:

$$(A1-B1)\times P1\times N1\times(L-M)\leq(A2-B2)\times P2\times N2\times L$$

wherein the number of threads of the first blade portion is three, and where M is a length of the clearance portion in the rotation-axis direction, A1 is an outer diameter of the first blade portion, B1 is an outer diameter of the first rotation shaft portion, P1 is a spiral lead of the first blade portion, N1 is a number of threads of the first blade portion, A2 is an outer diameter of the second blade portion, B2 is an outer diameter of the second rotation shaft portion, P2 is a spiral lead of the second blade portion, and N2 is a number of threads of the second blade portion, and wherein N1 equals three.

19. The developing apparatus according to claim 17, wherein the number of threads of the second blade portion is three, and wherein N2 equals three.

20. The developing apparatus according to claim 18, wherein the number of threads of the second blade portion is three, and wherein N2 equals three.

* * * * *